US006400105B2

(12) United States Patent
Uchida et al.

(10) Patent No.: US 6,400,105 B2
(45) **Date of Patent: *Jun. 4, 2002**

(54) COLOR CATHODE-RAY TUBE HAVING ELECTROSTATIC QUADRUPOLE LENS EXHIBITING DIFFERENT INTENSITIES FOR ELECTRON BEAMS

(75) Inventors: Go Uchida; Syoji Shirai; Shinichi Kato; Masafumi Nagaoka, all of Mobara (JP)

(73) Assignee: Hitachi, Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/066,756

(22) Filed: Apr. 27, 1998

(30) Foreign Application Priority Data

Sep. 5, 1997 (JP) ..... 9-241118

(51) Int. Cl.[7] ..... G09G 1/04
(52) U.S. Cl. ..... 315/382; 313/414; 313/449
(58) Field of Search ..... 315/382, 368; 313/382, 449, 414

(56) References Cited

U.S. PATENT DOCUMENTS

| | | | | |
|---|---|---|---|---|
| 4,334,169 A | * | 6/1982 | Takenaka et al. | 313/414 |
| 4,701,678 A | | 10/1987 | Blacker et al. | |
| 4,704,565 A | | 11/1987 | Blacker et al. | |
| 4,814,670 A | * | 3/1989 | Suzuki et al. | 315/15 |
| 4,886,999 A | | 12/1989 | Yamane et al. | |
| 5,015,910 A | | 5/1991 | Takahashi et al. | |
| 5,027,043 A | * | 6/1991 | Chen et al. | 315/368 |
| 5,061,881 A | | 10/1991 | Suzuki et al. | |
| 5,162,695 A | | 11/1992 | Shimona et al. | |
| 5,212,423 A | | 5/1993 | Noguchi et al. | |
| 5,300,855 A | | 4/1994 | Kweon | |
| 5,367,230 A | * | 11/1994 | Iguchi et al. | 315/368 |
| 5,382,872 A | | 1/1995 | Kim et al. | |
| 5,506,468 A | | 4/1996 | Koh | |
| 5,523,648 A | * | 6/1996 | Son et al. | 313/414 |
| 5,532,547 A | | 7/1996 | Park et al. | |
| 5,539,278 A | | 7/1996 | Takahashi | |
| 5,610,481 A | * | 3/1997 | Shirai et al. | 315/382 |
| 5,663,609 A | * | 9/1997 | Kamohara et al. | 313/412 |
| 5,739,630 A | | 4/1998 | Shirai et al. | |
| 5,739,631 A | | 4/1998 | Tojyou et al. | |
| 5,814,020 A | | 9/1998 | Jo | |
| 5,828,191 A | * | 10/1998 | Shirai et al. | 315/382 |
| 5,907,217 A | * | 5/1999 | Gorski et al. | 315/15 |
| 6,031,325 A | * | 2/2000 | Amano | 313/412 |
| 6,100,631 A | * | 8/2000 | Misono | 313/414 |

FOREIGN PATENT DOCUMENTS

| | | |
|---|---|---|
| JP | 5-266822 | 10/1993 |

* cited by examiner

*Primary Examiner*—Constantine Hannaher
*Assistant Examiner*—Shun Lee
(74) *Attorney, Agent, or Firm*—Antonelli, Terry, Stout & Kraus, LLP

(57) ABSTRACT

A focus electrode is constituted by a first type of focus electrode group to which a first focus voltage is applied, and a second type of focus electrode group to which a second focus voltage is applied. Between the first type of focus electrode group and the second type of focus electrode group are formed a lens at least having a lens action for correcting the field curvature and an electrostatic quadrupole lens. The center axes of the outer electron beam passage holes in the first type of focus electrode forming the lens at least having a lens action for correcting the field curvature are deviated on a horizontal plane from the center axes of the outer electron beam passage holes in the second type of focus electrode. The electrostatic quadrupole lens produces dissimilar intensities for the outer electron beams and for the center electron beam. Therefore, the outer electron beam passage holes work to deflect the outer electron beams toward the center electron beam with an increase in the deflecting amount of the electron beams, and a favorable resolution is obtained on the whole screen of the cathode-ray tube.

19 Claims, 28 Drawing Sheets

COLOR CATHODE-RAY TUBE HAVING ELECTROSTATIC QUADRUPOLE LENS EXHIBITING DIFFERENT INTENSITIES FOR ELECTRON BEAMS

BACKGROUND OF THE INVENTION

The present invention relates to a color cathode-ray tube and, more particularly, to a color cathode-ray tube including an electron gun which, in operation, emits three electron beams in line in a horizontal direction toward a fluorescent screen.

Owing to their fine picture-reproducing property, color cathode-ray tubes, such as color picture tubes or display tubes, have been extensively used for receiving TV broadcast programs and as monitors for data processing equipment.

The color cathode-ray tube of this type includes a panel portion having a face plate forming a fluorescent screen on the inner surface thereof, a neck portion containing an electron gun structure for emitting electron beams onto the fluorescent screen, and an evacuated envelope having at least a funnel portion for connecting said panel portion to said neck portion.

FIG. 39 is a diagram schematically illustrating, in cross section, the constitution of a shadow mask-type color cathode-ray tube to which the present invention is adapted, and wherein reference numeral 20 denotes a face plate portion, 21 denotes a neck portion, 22 denotes a funnel portion for connecting the panel portion to the neck portion, 23 denotes a fluorescent screen which constitutes an image display screen on the inner surface of the face plate, 24 denotes a shadow mask which operates as a color-selection electrode, 25 denotes a mask frame which constitutes a shadow mask structure to hold the shadow mask, 26 denotes an inner shield for shielding external magnetism, 27 denotes a suspension spring mechanism by which the shadow mask structure is suspended by studs that are located on the inner wall of the face plate, 28 denotes an electron gun accommodated in the neck portion for emitting three electron beams Bs (x2) and Bc in line, 29 denotes a deflection device for deflecting the electron beams in the horizontal and vertical directions, and reference numeral 30 denotes a magnetic device for correcting color purity or centering.

In the diagramed constitution, an evacuated envelope is constituted by the face plate 20, neck portion 21 and funnel portion 22. Three electron beams Bc and Bs (x2) emitted in line from the electron gun 28 are deflected in the horizontal and vertical directions by a deflecting magnetic field formed by the deflecting device 29 so as to two-dimensionally scan the fluorescent screen 23. Here, symbol Bc denotes a center beam, and Bs denotes a side beam.

The three electron beams Bc and Bs (x2) are each modulated by color signals of red (side beam Bs), green (center beam Bc) and blue (side beam Bs), subjected to the color selection through beam passage holes of the shadow mask 24 arranged in front of the fluorescent screen 23, and impinge upon fluorescent mosaics of red, green and blue colors that constitute the fluorescent screen 23 to reproduce a desired color image.

FIG. 40 is a horizontal sectional view of an in-line electron gun mounted in a conventional color cathode-ray tube, wherein reference numeral 1 denotes cathodes, 2 denotes a control electrode, 3 denotes an accelerating electrode, 4 denotes a focus electrode assembly, 5 denotes an anode, and reference numeral 6 denotes a shield cup. Reference numeral 41 denotes a first focus electrode, 42 denotes a second focus electrode, and the focus electrode assembly 4 is constituted by these focus electrodes. Reference numerals 411 and 421 denote plate electrodes constituting an electrostatic quadrupole lens.

Thermoelectrons emitted from the heated cathodes 1 are accelerated toward the control electrode 2 due to a potential applied to the accelerating electrode 3, whereby three electron beams are formed. The three electron beams pass through apertures in the control electrode 2 and pass through apertures in the accelerating electrode 3. Then, the three electron beams are focused to some extent by a prefocus lens formed between the accelerating electrode 3 and the first focus electrode 41 prior to entering into the main lens formed between the second focus electrode 42 and the anode 5, the beams being fed to the main lens while being accelerated by the potential of the focus electrode 4. The three electron beams are focused by the main lens formed between the second focus electrode 42 and the anode 5 on the fluorescent screen to form a projection spot.

The first focus electrode 41 is supplied with a predetermined voltage (Vf1) 7, and the second focus electrode 42 is supplied with a dynamic voltage (Vf2+dVf) 8 that changes in synchronism with a change in the deflection angle for scanning the electron beams on the screen. Symbol Eb denotes an anode voltage.

The intensity of the main lens is changed depending upon the deflection angle of the electron beam, thereby to correct the curvature of the image field. Any astigmatism is corrected by the electrostatic quadrupole lens constituted by the vertical plate electrode 411 and the horizontal plate electrode 421 mounted on the first focus electrode 41 and on the second focus electrode 42, in order to control the focusing distance of the electron beam and the shape of the beam spot, thereby obtaining a good focus on the screen at all times.

In the practical cathode-ray tube, however, a desired voltage is not obtained at the periphery of the screen due to a limitation on the drive circuit of the dynamic voltage 8, and a favorable beam spot is not obtained.

Japanese Patent Laid-Open No. 43532/1992 (U.S. Pat. No. 5,212,423) discloses a method which suppresses the amount of change in the dynamic voltage that varies in synchronism with the deflection angle, in order not to increase the diameter of the electron beams.

FIG. 41 is a horizontal sectional view illustrating the constitution of a conventional in-line type electron gun disclosed in the above-mentioned publication, wherein a focus electrode assembly 4 is constituted by a first focus electrode 43, a second focus electrode 44, a third focus electrode 45 and a fourth focus electrode 46. Reference numeral 442 denotes horizontal correction plate electrodes constituting the electrostatic quadrupole lens, and 454 denotes vertical correction plate electrodes for constituting an electrostatic quadrupole electrode. The same reference numerals as those of FIG. 40 denote portions having the same functions.

As shown, the focus electrode assembly 4 is divided into a plurality of electrode groups 43, 44, 45 and 46, and the electrostatic quadrupole lens is constituted by the horizontal plate electrodes 442 and vertical plate electrodes 454 among these focus electrode groups. Among these focus electrode groups there is further formed at least an electron lens which exhibits a strong focusing force in both the horizontal direction and the vertical direction. This electron lens (hereinafter referred to as a lens for correcting the field curvature) has a function for correcting the curvature of the image field, which corresponds to the inner surface of the panel.

Furthermore, a main lens formed between the opposing surfaces of the fourth focus electrode 46 and the anode 5 produces a strong astigmatism for vertically deforming the sectional shape of the electron beams. Here, in the conventional electron gun described above, a method of applying DC components (Vf1, Vf2) of two focus voltages must be changed in order to impart the action of the lens for correcting the field curvature to the electron lens that exhibits a strong focusing force in both the horizontal direction and the vertical direction. However, the method of applying a dynamic voltage is the same.

That is, so far, the two DC focus voltages have nearly equal values, and the dynamic voltage increases accompanying an increase in the amount of deflection of the electron beams. In the electron gun shown in FIG. 41, on the other hand, the one DC focus voltage (Vf1) is considerably greater than the other DC focus voltage (Vf2), and a difference in the voltage is set to be at least greater than a maximum value of the dynamic voltage (dV1).

Therefore, when the dynamic voltage increases, i.e., when the amount of deflection of the electron beam increases, the potential difference decreases in the lens in which the focusing force increases in both the horizontal direction and the vertical direction, and the intensity of the lens decreases. Therefore, the force for focusing the electron beam decreases when the electron beam is deflected, and the field curvature is corrected.

In FIG. 42, symbol 1H denotes a horizontal period and 1V denotes a vertical period.

Since the action for correcting the field curvature which is, so far, based on the main lens only is reinforced by at least a lens for correcting the field curvature, it is possible to lower the dynamic voltage for correction.

Furthermore, the main lens through which the electron beams of the outer sides pass, is axially asymmetric and works to deflect the electron beams of the outer sides toward the side of the central electron beam so that they are in agreement with the center beam on the fluorescent screen (so-called STC: static convergence). With the three electron beams in agreement on the fluorescent screens, the pictures of R, G and B colors due to the electron beams are properly superposed to display a color picture.

Due to the magnetic field generated by the deflection yoke, furthermore, the three electron beams are scanned on the fluorescent screen to display the picture. A self-convergence deflection yoke is used as the deflection yoke.

The shape of the inner surface of the panel (shape of the image field) is not spherical with respect to the center of deflection. When the magnetic field of the deflection yoke is symmetrical, therefore, the three electron beams that are coincident on the center of the fluorescent screen become out of coincidence when they are deflected. Therefore, the self-convergence deflection yoke so deflects the magnetic field that the magnetic field in the horizontal direction is distributed in a pin-cushion manner and the magnetic field in the vertical direction is distributed in an asymmetrical barrel shape, so that the three electron beams are coincident on the whole fluorescent screen.

Japanese Patent Laid-Open No. 72546/1990 (U.S. Pat. No. 4,851,741) discloses means for improving the convergence of the three electron beams on the fluorescent screen.

This is the technology for improving the phenomenon in which the focus voltage applied to the focus electrode (fourth focus electrode 46 in FIG. 41) opposed to the anode 5 to form a main lens, varies in synchronism with a change in the deflection angle for scanning the electron beams on the screen, causing the intensity of the main lens formed by the anode 5 and the fourth focus electrode 46 to be changed and, hence, causing the STC action of the main lens to be varied.

In other words, the STC is varied by the electrostatic quadrupole lens in a direction opposite to the change in the STC caused by the main lens, so that variations in the STC caused by the lenses are canceled by each other.

According to this method, the STC is changed by the electrostatic quadrupole lens, and the astigmatism is corrected simultaneously with the STC. Therefore, a high degree of technology is required for optimizing the structure for simultaneously satisfying the STC and the correction of astigmatism. Besides, when the sizes of the electrodes constituting the electrostatic quadrupole lens undergo a change, both the STC and the correction of astigmatism are changed, and the screen resolution is deteriorated. Therefore, strict accuracy is required for the electrodes constituting the electrostatic quadrupole lens.

According to Japanese Patent Laid-Open No. 31332/1996, the STC is varied by the electrostatic quadrupole lens and, at the same time, the astigmatism is corrected. Besides, the intensity of the lens is varied by the electrostatic quadrupole lens for the center electron beam and by the electrostatic quadrupole lens for the side electron beams.

This method, too, requires a high degree of technology for optimizing the electrode structure for satisfying both the STC and the correction of astigmatism. Besides, when the sizes of the electrodes constituting the electrostatic quadrupole lens undergo a change, both the STC and the correction of astigmatism are changed, and the screen resolution is deteriorated. Therefore, strict accuracy is required for the electrodes constituting the electrostatic quadrupole lens.

According to Japanese Patent Laid-Open No. 31333/1996 (U.S. Pat. No. 5,608,284) filed by the present applicant, the action for canceling a change in the STC caused by the main lens (action for correcting a change in the STC) is exhibited by a lens for correcting the field curvature, but not by the electrostatic quadrupole lens.

The electron gun disclosed in the above-mentioned Japanese Patent Laid-Open No. 31333/1996 (U.S. Pat. No. 5,608,284) can be easily produced since the lens for correcting the field curvature exhibits an action for canceling a change in the STC caused by the main lens.

According to the electron gun disclosed in Japanese Patent Laid-Open No. 31333/1996 (U.S. Pat. No. 5,608,284), however, no attention has been given in regard to maintaining balance between the intensity of the lens for correcting the field curvature for the center electron beam and the intensity of the lens for correcting the field curvature for the outer electron beams. The present inventors have discovered the fact that the center electron beam and the outer electron beams lose balance so as to form spots.

In order to cancel a change in the STC caused by the main lens, the electrodes belonging to the first type of focus electrode group forming the lens for correcting the field curvature and the electrodes belonging to the second type of focus electrode group, have three electron beam passage holes that are arranged in the horizontal direction. Here, the substantial centers of the outer electron beam passage holes in an electrode belonging to the second type of focus electrode group are deviated with respect to the substantial centers of the outer electron beam passage holes in the electrode belonging to the first type of focus electrode group, in order to deflect the outer electron beams toward the center electron beam with an increase in the deflecting amount of the electron beams.

Since the substantial centers of the outer electron beam passage holes in the electrode belonging to the second type of focus electrode group are deviated relative to the substantial centers of the outer electron beam passage holes in the electrode belonging to the first type of focus electrode group, the lens for correcting the field curvature exhibits different intensities for the outer electron beams passing through the holes and for the center electron beam passing through the hole.

Therefore, a difference develops in a ratio of the diameter of the outer electron beams incident on the main lens in the horizontal direction to the diameter thereof in the vertical direction, and in a ratio of the diameter of the center electron beam incident on the main lens in the horizontal direction to the diameter thereof in the vertical direction, with an increase in the difference between a first focus voltage applied to the first type of focus electrode group and a second focus voltage applied to the second type of focus electrode group.

At the center of the screen where the difference becomes a maximum between the first focus voltage applied to the first type of focus electrode group and the second focus voltage applied to the second type of focus electrode group, the difference becomes a maximum between the ratio of the diameter of the outer electron beam incident on the main lens in the horizontal direction to the diameter thereof in the vertical direction and the ratio of the diameter of the center electron beam incident on the main lens in the horizontal direction to the diameter thereof in the vertical direction.

The difference in the ratios of the diameter in the horizontal direction to the diameter in the vertical direction between the center electron beam and the outer electron beams incident on the main lens causes the center electron beam and the outer electron beams to lose balance, resulting in the formation of spots.

SUMMARY OF THE INVENTION

The object of the present invention is to provide a color cathode-ray tube, which avoids the effects of the above-mentioned prior art and which is equipped with an electron gun which makes it possible to obtain an excellent resolution over the whole screen.

The present invention relates to a color cathode-ray tube comprising at least an electron beam-generating portion for generating three electron beams which are arranged in a horizontal direction and are controlled, an electron gun having a main lens for focusing the three electron beams generated by said electron beam-generating portion on a fluorescent screen, and a deflection yoke for scanning said three electron beams on the fluorescent screen in both the horizontal direction and the vertical direction.

A main lens in the electron gun comprises an anode to which an anode voltage is applied, a first type of focus electrode group to which is applied a first focus voltage which is a predetermined voltage, and a second type of focus electrode group to which a second focus voltage is applied, the electrodes belonging to the second type focus electrode group neighboring the anode. The second focus voltage is obtained by superposing a dynamic voltage that changes depending upon the amount of deflection of the electron beams on a predetermined voltage, which is lower than the first focus voltage.

Between the first type of focus electrode group and the second type of focus electrode group, there are formed at least two electron lenses, i.e., a lens for correcting the field curvature which exhibits an increasing force for focusing the three electron beams in both the horizontal direction and the vertical direction with an increase in the potential difference between the first focus voltage and the second focus voltage, and an electrostatic quadrupole lens which exhibits a large force for focusing said three electron beams in either the horizontal direction or the vertical direction and a large force for diverging the three electron beams in the other of these directions.

Three electron beam passage holes arranged in a horizontal direction are formed in the electrode belonging to the first type of focus electrode group and in the electrode belonging to the second type of focus electrode group. The three electron beam passage holes are so arranged that the centers of the outer electron beam passage holes of the electrode belonging to the second type of focus electrode group are deviated on a horizontal plane relative to the centers of the outer electron beam passage holes of the electrode belonging to the first type of focus electrode group. Furthermore, the electrostatic quadrupole lens exhibits dissimilar intensities for the outer electron beams and for the center electron beam.

In order to accomplish the above-mentioned objects, the features of the present invention resides in the below-mentioned constitutions (1) to (17).

(1) A color cathode-ray tube comprising at least an electron beam-generating portion for generating three electron beams that are arranged in a horizontal direction and are controlled, an electron gun having a main lens portion for focusing the three electron beams generated by said electron beam-generating portion on a fluorescent screen, and a deflection yoke for scanning said three electron beams on the fluorescent screen in both the horizontal direction and the vertical direction; wherein an electrode group for forming said electron beam-generating portion and an electrode group for forming said main lens have center beam passage holes of which the center axes are in agreement with each other;

the main lens of said electron gun includes an anode to which an anode voltage is applied, a first type of focus electrode group to which a first focus voltage is applied, and a second type of focus electrode group to which a second focus voltage is applied;

an electrode belonging to the second type of focus electrode group neighbors said anode, and said second focus voltage is obtained by superposing, on a predetermined voltage, a dynamic voltage that changes depending upon the amount of deflection of the electron beams;

between the first type of focus electrode group and the second type of focus electrode group are formed at least two electron lenses, i.e., a lens for correcting the field curvature which exhibits an increasing force for focusing the three electron beams in both the horizontal direction and the vertical direction with an increase in the potential difference between the first focus voltage applied to said first type of focus electrode group and the second focus voltage applied to said second type of focus electrode group, and an electrostatic quadrupole lens which exhibits a large force for focusing said three electron beams in either the horizontal direction or the vertical direction and a large force for diverging the three electron beams in the other of these directions;

among said three electron beam passage holes arranged in a horizontal direction in the electrode belonging to said first type of focus electrode group and in the electrode belonging to said second type of focus electrode group forming said lens for correcting the field curvature, the outer electron beam passage holes are so arranged that the substantial centers of the outer electron beam passage holes in the electrode belonging to said second type of focus electrode group are deviated on a horizontal plane relative to the substantial centers of the outer electron beam passage holes in the electrode belonging to the first type of focus electrode group, so that the outer electron beams are deflected toward the center electron beam with an increase in the deflecting amount of the electron beams; and said electrostatic quadrupole lens has an electrode constitution which exhibits different intensities for the outer electron beams and for the center electron beam.

(2) A color cathode-ray tube of constitution (1), wherein the substantial centers of said outer electron beam passage holes in the electrode belonging to said first type of focus electrode group are deviated toward the center electron beam relative to the substantial centers of the outer electron beam passage holes in the electrode belonging to said second type of focus electrode group, said first type of focus electrode group forming a lens for correcting the field curvature that works to deflect the outer electron beams toward the center electron beam with an increase in the deflecting amount of the electron beams, and said electrostatic quadrupole lens has an electrode constitution which exhibits a stronger intensity for the outer electron beams than for the center electrode beam.

(3) A color cathode-ray tube of constitution (2), wherein said electrostatic quadrupole lens is constituted by vertical plate electrodes formed on the electrode belonging to said first type of focus electrode group to sandwich the center electrode beam and the electrode beams on both sides from the two sides in the horizontal direction, and at least a pair of horizontal plate electrodes formed on the electrode belonging to the second type of focus electrode group to sandwich the center electron beam and the electrode beams on both sides from the upper and lower sides in the vertical direction, and among said vertical plate electrodes, the vertical plate electrodes sandwiching the electron beams on both sides have a gap in the horizontal direction which is smaller than a gap between the vertical plate electrodes sandwiching the center electron beam in the horizontal direction.

(4) A color cathode-ray tube according to constitution (2), wherein said electrostatic quadrupole lens is constituted by vertical plate electrodes formed on the electrode belonging to said first type of focus electrode group to sandwich the center electrode beam and the electrode beams on both sides from the two sides in the horizontal direction, and at least a pair of horizontal plate electrodes formed on the electrode belonging to the second type of focus electrode group to sandwich the center electron beam and the electrode beams on both sides from the upper and lower sides in the vertical direction, and among said horizontal plate electrodes, the horizontal plate electrodes sandwiching the electron beams on both sides have a gap in the vertical direction which is smaller than a gap between the horizontal plate electrodes sandwiching the center electron beam in the vertical direction.

(5) A color cathode-ray tube of constitution (2), wherein said electrostatic quadrupole lens is constituted by vertical plate electrodes formed on the electrode belonging to said first type of focus electrode group to sandwich the center electrode beam and the electrode beams on both sides from the two sides in the horizontal direction, and at least a pair of horizontal plate electrodes formed on the electrode belonging to the second type of focus electrode group to sandwich the center electron beam and the electrode beams on both sides from the upper and lower sides in the vertical direction, and wherein at least either said vertical plate electrodes or said horizontal plate electrodes are so constituted that the length of the plate electrodes sandwiching the electron beams of both sides in the axial direction of the tube is greater than the length of the plate electrodes sandwiching the center electron beam in the axial direction of the tube.

(6) A color cathode-ray tube of constitution (2), wherein said electrostatic quadrupole lens is constituted by vertical plate electrodes formed on the electrode belonging to said first type of focus electrode group to sandwich the center electrode beam and the electrode beams on both sides from the two sides in the horizontal direction, and at least a pair of horizontal plate electrodes formed on the electrode belonging to the second type of focus electrode group to sandwich the center electron beam and the electron beams on both sides from the upper and lower sides in the vertical direction, and wherein at least either said vertical plate electrodes or said horizontal plate electrodes sandwiching the electron beams of both sides in the vertical direction or in the horizontal direction, have a width which is larger than the width of the plate electrodes sandwiching the center electron beam.

(7) A color cathode-ray tube of constitution (2), wherein said electrostatic quadrupole lens is constituted by electron beam passage holes in the electrode belonging to said first type of focus electrode group, and at least a pair of horizontal plate electrodes formed on the electrode belonging to said second type of focus electrode group at end surfaces opposed to the electrode that belongs to said first type of focus electrode group to sandwich the center electron beam and the electron beams on both sides from the upper side and the lower side in the vertical direction, and, among the electron beam passage holes in the electrode belonging to said first type of focus electrode group, the ratio of the diameter of the outer electron beam passage holes in the vertical direction to the diameter thereof in the horizontal direction is greater than the ratio of the diameter of the center electron beam passage hole in the vertical direction to the diameter thereof in the horizontal direction.

(8) A color cathode-ray tube of constitution (2), wherein the ratio (diameter in the vertical direction/diameter in the vertical direction) of the diameter in the vertical direction of the outer electron beam passage holes among the electron beam passage holes in the electrode belonging to said first type of focus electrode group forming the electrostatic quadrupole lens to the diameter thereof in the horizontal direction is greater than the ratio of the diameter of the center electron beam passage hole in the horizontal direction to the diameter thereof in the vertical direction.

(9) A color cathode-ray tube of constitution (2), wherein the ratio of the diameter in the vertical direction of the outer electron beam passage holes among the electron beam passage holes in the electrode belonging to said second type of focus electrode group forming the electrostatic quadrupole lens to the diameter thereof in the horizontal direction is smaller than the ratio of the diameter of the center electron beam passage hole in the vertical direction to the diameter thereof in the horizontal direction.

(10) A color cathode-ray tube of constitution (1), wherein the substantial centers of said outer electron beam passage holes in the electrode belonging to said second type of focus electrode group are deviated toward a direction opposite to the center electron beam relative to the substantial centers of the outer electron beam passage holes in the electrode belonging to said first type of focus electrode group, said second type of focus electrode group forming a lens for correcting the field curvature that works to deflect the outer electron beams toward the center electron beam with an increase in the amount of deflection of the electron beams, and said electrostatic quadrupole lens has an electrode constitution which exhibits a weaker intensity for the outer electron beams than for the center electrode beam.

(11) A color cathode-ray tube of constitution (10), wherein said electrostatic quadrupole lens is constituted by vertical plate electrodes formed on the electrode belonging to said first type of focus electrode group to sandwich the center electron beam and the electron beams on both sides from the two sides in the horizontal direction, and at least a pair of horizontal plate electrodes formed on the electrode belonging to the second type of focus electrode group to sandwich the center electron beam and the electron beams on both sides from the upper and lower sides in the vertical direction, and among said vertical plate electrodes, the vertical plate electrodes sandwiching the electron beams on both sides have a gap in the horizontal direction which is larger than a gap between the vertical plate electrodes sandwiching the center electron beam in the horizontal direction.

(12) A color cathode-ray tube according to constitution (10), wherein said electrostatic quadrupole lens is constituted by vertical plate electrodes formed on the electrode belonging to said first type of focus electrode group to sandwich the center electron beam and the electron beams on both sides from the two sides in the horizontal direction, and at least a pair of horizontal plate electrodes formed on the electrode belonging to the second type of focus electrode group to sandwich the center electron beam and the electrode beams on both sides from the upper and lower sides in the vertical direction, and among said horizontal plate electrodes, the horizontal plate electrodes sandwiching the electron beams on both sides having a gap in the vertical direction which is larger than a gap between the horizontal plate electrodes sandwiching the center electron beam in the vertical direction.

(13) A color cathode-ray tube of constitution (10), wherein said electrostatic quadrupole lens is constituted by vertical plate electrodes formed on the electrode belonging to said first type of focus electrode group to sandwich the center electron beam and the electron beams on both sides from the two sides in the horizontal direction, and at least a pair of horizontal plate electrodes formed on the electrode belonging to the second type of focus electrode group to sandwich the center electron beam and the electrode beams on both sides from the upper and lower sides in the vertical direction, and wherein at least either said vertical plate electrodes or said horizontal plate electrodes are so constituted that the length of the plate electrodes sandwiching the electron beams of both sides in the axial direction of the tube is smaller than the length of the plate electrodes sandwiching the center electron beam in the axial direction of the tube.

(14) A color cathode-ray tube of constitution (10), wherein said electrostatic quadrupole lens is constituted by vertical plate electrodes formed on the electrode belonging to said first type of focus electrode group to sandwich the center electron beam and the electron beams on both sides from the two sides in the horizontal direction, and at least a pair of horizontal plate electrodes formed on the electrode belonging to the second type of focus electrode group to sandwich the center electron beam and the electron beams on both sides from the upper and lower sides in the vertical direction, and wherein at least either said vertical plate electrodes or said horizontal plate electrodes sandwiching the electron beams of both sides in the vertical direction or in the horizontal direction, have a width which is smaller than the width of the plate electrodes sandwiching the center electron beam.

(15) A color cathode-ray tube of constitution (10), wherein said electrostatic quadrupole lens is constituted by electron beam passage holes in the electrode belonging to said first type of focus electrode group, and at least a pair of horizontal plate electrodes formed on the electrode belonging to said second type of focus electrode group at end surfaces opposed to the electrode that belongs to said first type of focus electrode group to sandwich the center electron beam and the electron beams on both sides from the upper side and the lower side in the vertical direction, and, among the electron beam passage holes in the electrode belonging to said first type of focus electrode group, the ratio of the diameter of the outer electron beam passage holes in the vertical direction to the diameter thereof in the horizontal direction is smaller than the ratio of the diameter of the center electron beam passage hole in the vertical direction to the diameter thereof in the horizontal direction.

(16) A color cathode-ray tube of constitution (10), wherein the ratio of the diameter in the vertical direction of the outer electron beam passage holes among the electron beam passage holes in the electrode belonging to said first type of focus electrode group forming the electrostatic quadrupole lens to the diameter thereof in the horizontal direction is smaller than the ratio of the diameter of the center electron beam passage hole in the vertical direction to the diameter thereof in the horizontal direction.

(17) A color cathode-ray tube of constitution (10), wherein the ratio of the diameter in the vertical direction of the outer electron beam passage holes among the electron beam passage holes in the electrode belonging to said second type of focus electrode group forming the electrostatic quadrupole lens to the diameter thereof in the horizontal direction is greater than the ratio of the diameter of the center electron beam passage hole in the vertical direction to the diameter thereof in the horizontal direction.

The above-mentioned constitutions make it possible to decrease the dynamic voltage, to decrease a change in the STC, to eliminate spot-like imbalance of the electron beams on the screen and, hence, to obtain a favorable resolution on the whole screen.

The effects owing to the constitutions of the present invention will become more obvious from the following description of various embodiments of the invention when considered with the accompanying drawings.

BRIEF DESCRIPTION OF THE DRAWINGS

FIG. 41 is a horizontal sectional view illustrating the constitution of a conventional in-line electron gun; and.

DETAILED DESCRIPTION OF THE PREFERRED EMBODIMENTS

Figure 39:
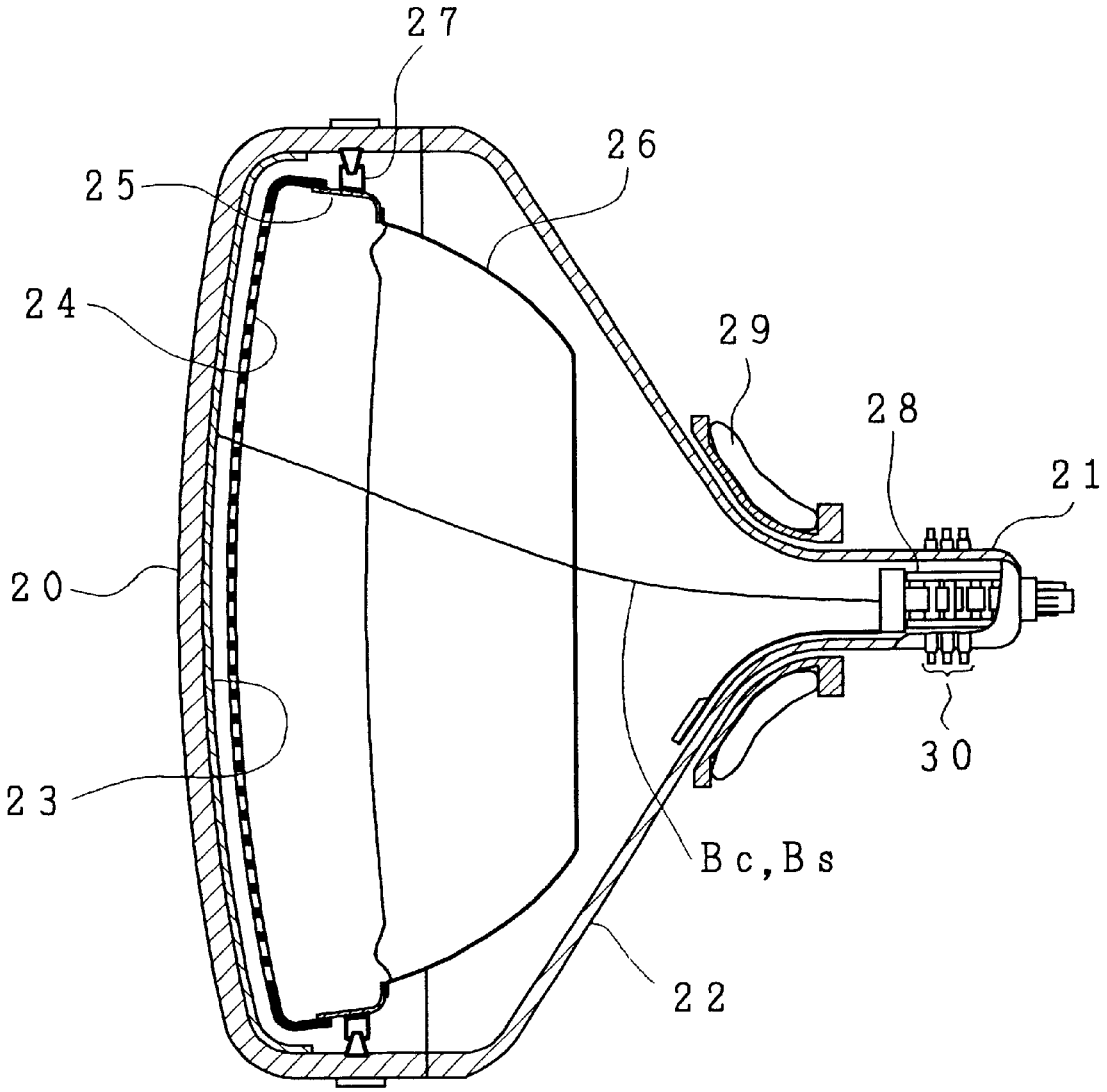
FIG. 39 PRIOR ART
FIG. 39 is a sectional view schematically illustrating the constitution of a shadow mask-type color cathode-ray tube to which the present invention is adapted.
Figure 40:
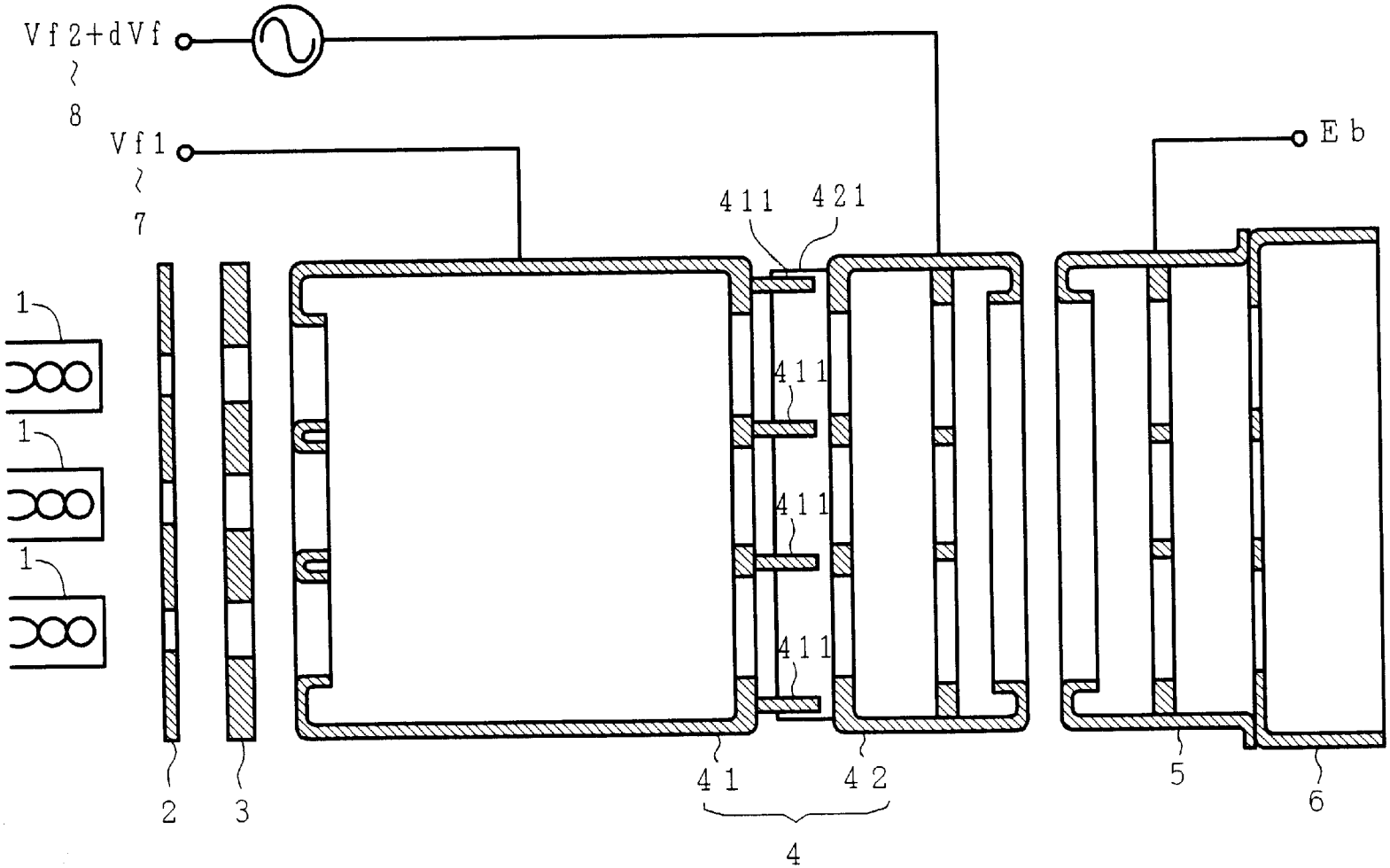
FIG. 40 PRIOR ART
FIG. 40 is a horizontal sectional view of an in-line electron gun mounted in a conventional color cathode-ray tube.
Figure 41:
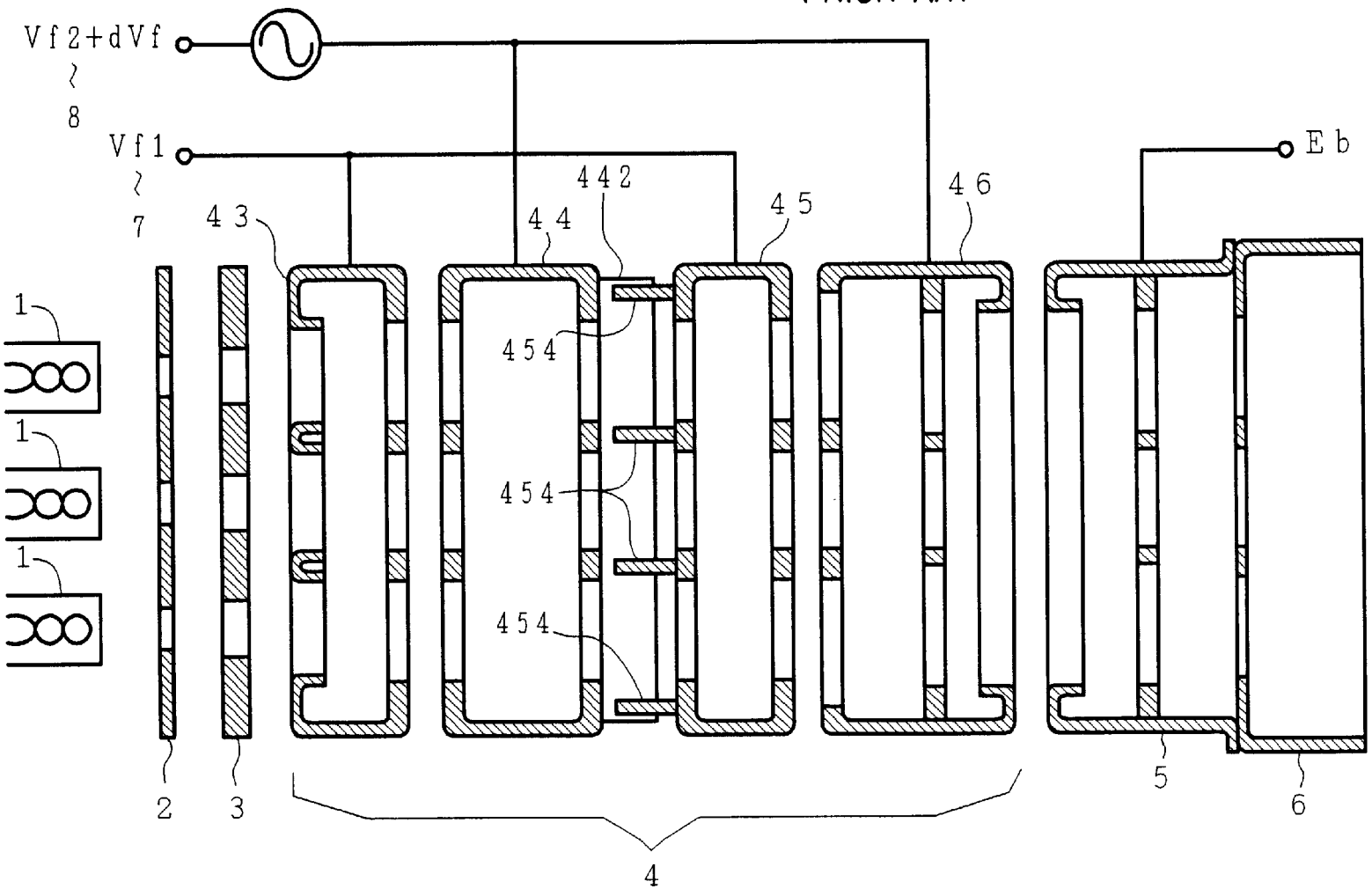
FIG. 41 PRIOR ART

Embodiments of the invention will now be described in detail. The invention is adapted to a color cathode-ray tube shown in FIG. 39.

A first embodiment deals with an electron gun in which the center axes of the outer electron beam passage holes in the second type of focus electrode are in agreement with the center axes of the outer sides, and the center axes of the outer electron beam passage holes in the first type of focus electrode are inwardly deviated relative to the center axes of the outer electron beam passage holes in the second type of focus electrode.

Figure 1:
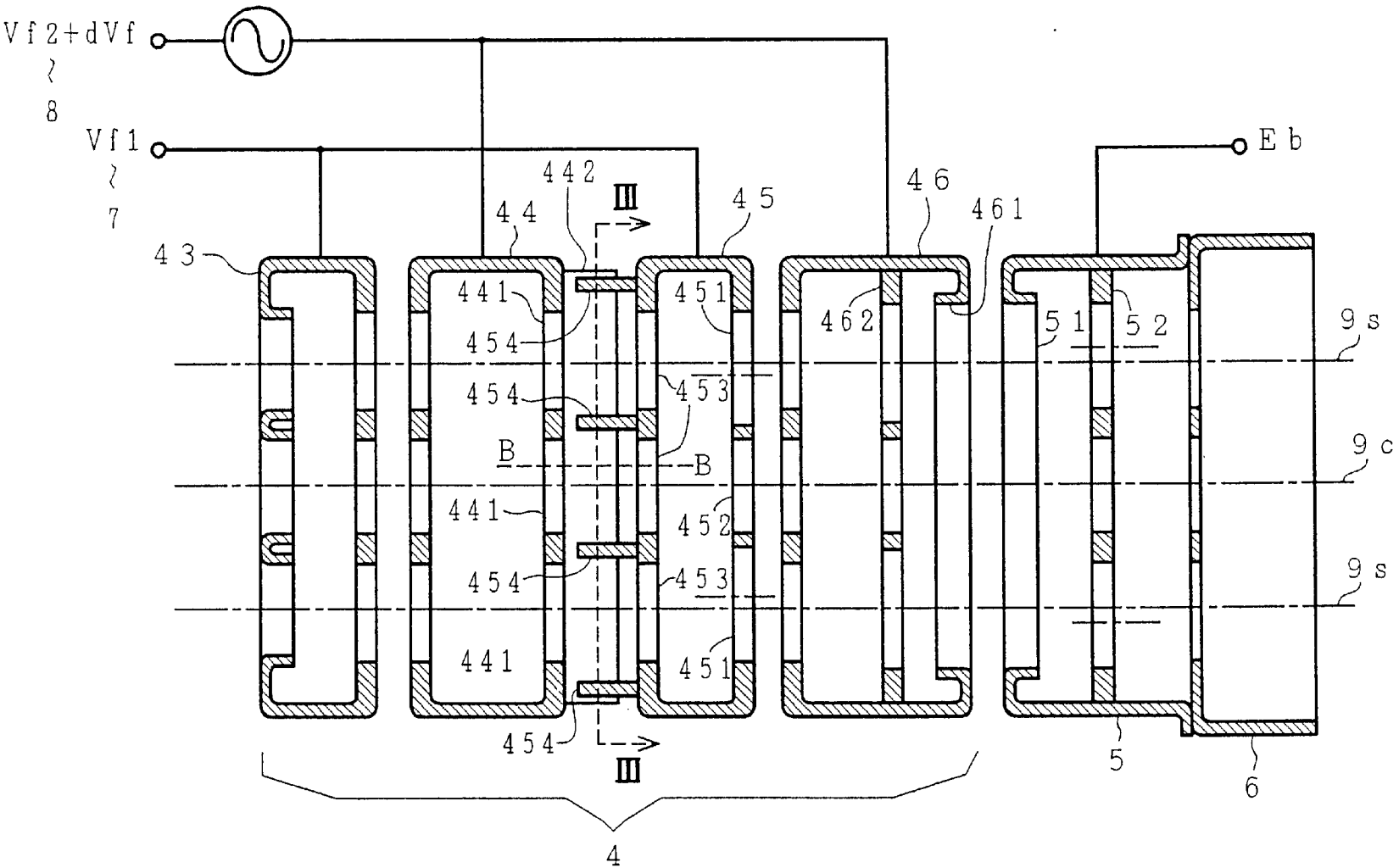
FIG. 1 is a sectional view of a main lens for explaining an electron gun used for a color cathode-ray tube according to a first embodiment of the present invention.
Figure 2:
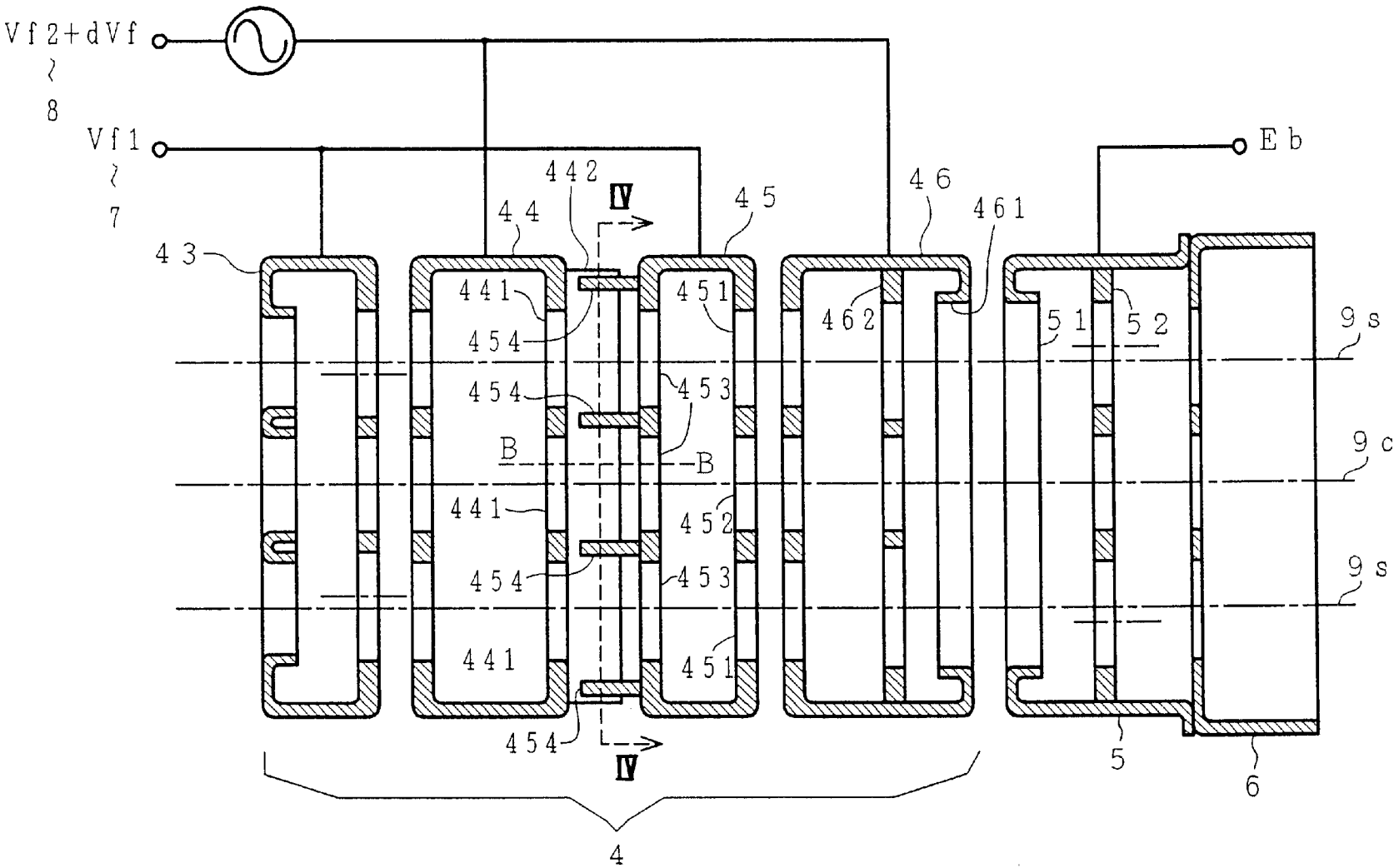
FIG. 2 is a sectional view of the main lens in the electron gun having another structure according to the first embodiment of the present invention.

FIGS. 1 and 2 are diagrams illustrating a first embodiment of an electron gun used for a color cathode-ray tube of the present invention and are sectional views illustrating chiefly a main lens. That is, FIGS. 1 and 2 are sectional views of an electron gun which forms an electrostatic quadrupole lens by using horizontal plate electrodes sandwiching the three electron beams from the upper side and the lower side, and horizontal plate electrodes sandwiching the electron beams from the right side and the left side. In FIGS. 1 and 2, the same portions are denoted by the same reference numerals.

The three electron beams are emitted from the cathodes along the center axes 9 (center axis 9S of the outer side, center axis 9C at the center, center axis 9S of the outer side) nearly in parallel with the direction (horizontal direction) of a common plane, and fall on a main lens passing through an accelerating electrode and a control electrode. Here, the center axes of the center beam passage holes through which the center beam passes are in agreement among the electrodes.

In the drawings, reference numeral 4 denotes a focus electrode assembly, 5 denotes an anode, and 6 denotes a shield cup electrode. The focus electrode assembly 4 is constituted by an electrode group which includes a first electrode member 43 operating as a first focus electrode, a second electrode member 44 operating as a second focus electrode, a third electrode member 45 operating as a third focus electrode, and a fourth electrode member 46 operating as a fourth focus electrode.

The first electrode member 43 and the third electrode member 45 are supplied with a first predetermined focus voltage (Vf1) and form a first type of focus electrode group.

Figure 42:
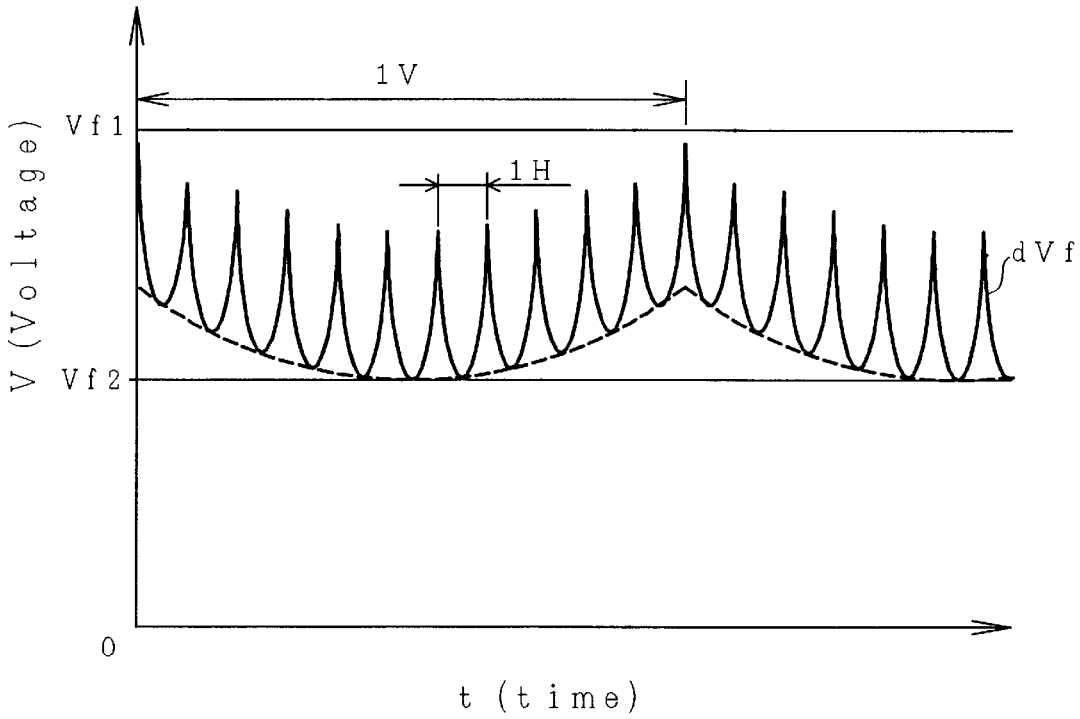
FIG. 42 PRIOR ART
FIG. 42 is a diagram illustrating the waveform of a focus voltage applied to the divided focus electrodes.

The second electrode member 44 and the fourth electrode member 46 are supplied with a second focus voltage (Vf2+dVf) obtained by superposing a dynamic voltage dVf that changes in synchronism with the deflection of the electron beams on a predetermined voltage Vf2 as shown in FIG. 42, and form a second type of focus electrode group.

An anode voltage Eb of about 20 to 30 kV is applied to the anode 5 and to the shield cup electrode 6.

A main lens (electron lens of the last stage) is formed between the anode 5 and the fourth electrode member 46. The main lens is constituted by single large-diameter openings 461, 51 in the opposing surfaces of the electrodes, and by electrode plates 462, 52 arranged inside the electrodes and having oval electron beam passage holes as disclosed in, for example, Japanese Patent Laid Open No. 103762/83 (U.S. Pat. No. 4,581,560).

The main lens exhibits a strong astigmatism so as to produce a focusing force which is stronger in the horizontal direction than in the vertical direction. The main lens through which the outer electron beams pass is axially asymmetric and exhibits an action (STC: static convergence) to deflect the outer electron beams toward the center electron beam so that they are in agreement on the fluorescent screen. Upon bringing the three electron beams into agreement on the fluorescent screen, the pictures of R, G, B colors due to the electron beams are properly superposed, making it possible to display a color image.

In order to further strengthen the converging action of the main lens, the electrodes for forming the main lens shown in FIGS. 1 and 2 are so formed that the distance between the center axis 9S of an outer beam passage hole and the center axis 9C of the center beam passage hole, among the three electron beam passage holes formed in the electrode plate 462, is not the same as the distance between the center axis 9S of the outer beam passage hole and the center axis 9C of the center beam passage hole among the three electron beam passage holes formed in the electrode 52. That is, the center axes of the outer holes are deviated from each other between the two electrodes that constitute the main lens.

Lenses for correcting the field curvature are formed between the first electrode member 43 and the second electrode member 44, and between the third electrode member 45 and the fourth electrode member 46.

These lenses for correcting the field curvature exhibit a focusing action in the horizontal direction and in the vertical direction.

The electron gun shown in FIGS. 1 and 2 represents a first embodiment, in which the center axes of the outer electron beam passage holes in the first type of focus electrode are inwardly deviated relative to the center axes of the outer electron beam passage holes in the second type of focus electrode, and the center axes of the outer electron beam passage holes in the second type of focus electrode are in agreement with the center axes 9S of the outer sides.

In FIG. 1, the center axes of the outer electron beam passage holes in the third electrode member 45 and the center axes of the outer electron beam passage holes in the fourth electrode member 46, are deviated. In this case, the outer electron beam passage holes in the fourth electrode member 46 are in agreement with the center axes 9S of the outer sides, and the center axes of the outer electron beam passage holes in the third electrode member 45 are inwardly deviated relative to the center axes 9S of the outer sides.

That is, the substantial centers of the outer electron beam passage holes 451 in the third electrode member 45 on the side of the fourth electrode member 46 are deviated toward the center electron beam passage hole 452 relative to the outer electron beams on a horizontal plane.

In the electron gun shown in FIG. 1, in particular, the electron lens for correcting a change in the STC of the main lens is located close to the main lens, making it possible to accomplish a fine adjustment to meet a change in the STC of the main lens. The structure having at least two lenses for correcting the field curvature and in which the lens for correcting the field curvature of the anode side exhibits an action for correcting a change in the STC, as shown in FIG. 1, is hereinafter referred to as a succeeding-stage offset structure.

In the succeeding-stage offset structure, the electrode is offset at a position close to the main lens to correct a change in the STC. In other words, the lens for correcting the field curvature exhibiting the action for correcting a change in the STC is formed at a position close to the main lens and is little affected by another electron lens. In the structure shown in FIG. 1, the lens for correcting the field curvature exhibiting the action for correcting a change in the STC is adjacent the main lens and is capable of correcting a change in the STC without being affected by another electron lens.

In FIG. 2, the center axes of the outer electron beam passage holes in the first electrode member 43 are deviated from the center axes of the outer electron beam passage holes in the second electrode member 44. Here, the outer electron beam passage holes in the second electrode member 44 are in agreement with the center axes 9S of the outer sides, and the center axes of the outer electron beam passage holes in the first electrode member 43 are inwardly deviated relative to the center axes 9S of the outer sides.

That is, the substantial centers of the outer electron beam passage holes of the first electrode member 43, on the side of the second electrode member 44, are deviated toward the center electron beam passage hole relative to the outer electron beams on a plane. The structure having at least two lenses for correcting the field curvature, and in which the lens for correcting the field curvature of the cathode side exhibits the action for correcting a change in the STC, as shown in FIG. 2, is hereinafter referred to as a preceding-stage offset structure.

In the preceding-stage offset structure, the electrode for correcting a change in the STC is offset at a position remote from the main lens. Since the lens for correcting the field curvature exhibiting the action for correcting a change in the STC is remote from the main lens, the distance for deviating the electrode can be shortened.

Figure 3:
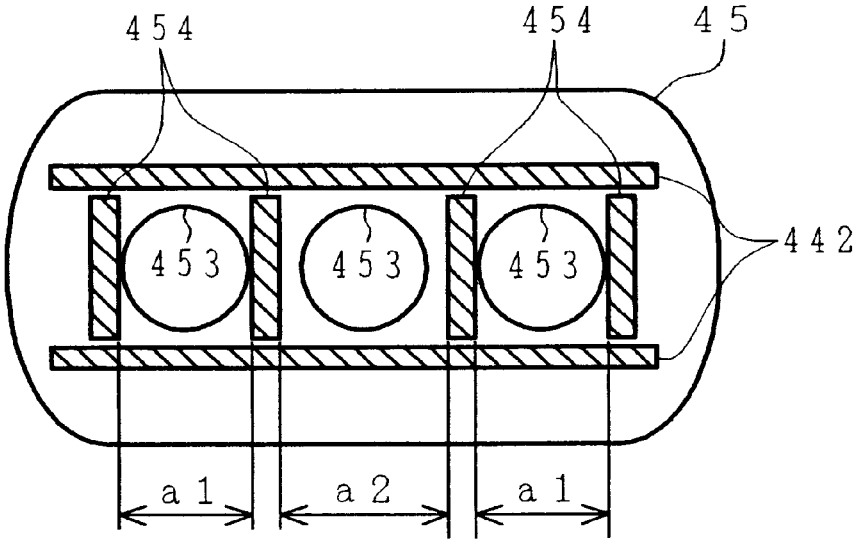
FIG. 3 is a sectional view illustrating a first constitution of an electrostatic quadrupole lens according to the first embodiment of the present invention.

FIG. 3 is a diagram illustrating a first constitution of the electrostatic quadrupole lens according to the first embodiment and is a sectional view along the lines IIIA—IIIA and IIIB—IIIB in FIGS. 1 and 2. Referring to FIG. 3, an electrostatic quadrupole lens is constituted between the second electrode member 44 and the third electrode member 45.

That is, three electron beam passage holes 441 corresponding to the three electron beams are formed in the second electrode member 44 on the side of the third electrode member 45, and horizontal plate electrodes 442 extending toward the third electrode member 45 are provided at the upper and lower sides of the electron beam passage holes 441 in the vertical direction. Furthermore, three electron beam passage holes 453 corresponding to the three electron beams are formed in the third electrode member 45 on the side of the second electrode member 44, and vertical plate electrodes 454 extending toward the second electrode member 44 are provided to sandwich the electron beam passage holes 453 from both sides thereof in the horizontal direction.

There exists a relationship a1<a2 between a gap a1 of the vertical plate electrodes sandwiching the outer electron beam in the horizontal direction and the vertical plate electrodes sandwiching the center electron beam in the horizontal direction.

In the electron gun thus constituted, the focus voltages shown in FIG. 42 are applied to the focus electrodes. That is, a first focus voltage (Vf1) 7 of about 7 to 10 kV is applied to the first type of focus electrode group (first electrode member 43 and third electrode member 45) constituting the focus electrode 4. A second focus voltage (Vf2+dVf) 8 obtained by superposing a dynamic voltage (dVf) on a predetermined voltage (Vf2) of 6 to 9 kV lower than the first focus voltage Vf1, is applied to the second type of focus electrode group (second electrode member 44 and fourth electrode member 45).

The dynamic voltage dVf has a waveform synthesized from a parabolic waveform having a period corresponding to the horizontal deflection period 1H of the electron beams and a parabolic waveform having a vertical direction period 1V. A peak-to-peak value of the dynamic voltage dVf is smaller than a difference between Vf1 and Vf2. Therefore, the potential of the first type of focus electrode group is higher than the potential of the second type of focus electrode group at all times.

In the electron gun shown in FIG. 1, therefore, the potential of the third electrode member 45 is higher than the potential of the fourth electrode member 46 at all times. Accordingly, the lens formed between the third electrode member 45 and the fourth electrode member 46 works to deflect the outer electron beams toward a direction opposite to the center electron beam.

Considered below is a case where the second focus voltage (Vf2+dVf) forming the main lens increases. The potential difference decreases between the anode 5 and the fourth electrode member 46 constituting the main lens and, hence, the intensity of the main lens decreases, resulting in a decrease in the action for deflecting the outer electron beams toward the center electron beam. Therefore, the outer electron beams are outwardly deflected. The direction opposite to the side of the center electron beam is referred to as the outer side, and the side of the center electron beam is referred to as the inner side.

In the electron gun of FIG. 1, in this case, the potential difference decreases between the third electrode member 45 and the fourth electrode member 46, and the lens formed between the third electrode member 45 and the fourth electrode member 46 exhibits a decreased intensity. Accordingly, the action becomes weak for deflecting the outer electron beams toward the direction opposite to the center electron beam, and the outer electron beams are deflected toward the center electron beam. Therefore, the converging actions of the main lens and of the lens formed between the third electrode member 45 and the fourth electrode member 46 are canceled by each other and, as a result, the STC does not change.

The substantial centers of the outer electron beam passage holes 451 in the third electrode member 45 on the side of the fourth electrode member 46 are deviated from the substantial centers of the outer electron beam passage holes in the fourth electrode member 46 on the side of the third electrode member 45.

In FIG. 1, the substantial centers of the outer electron beam passage holes in the third electrode member 45 on the side of the fourth electrode member 46 are deviated on a horizontal plane toward the center electron beam passage holes relative to the center axes 9S of the outer sides. The diameter of the outer electron beam passage holes in the third electrode member 45 on the side of the fourth electrode member 46 in the horizontal direction is greater than the diameter of the center electron beam passage hole in the horizontal direction.

The third electrode member 45 has a potential higher than that of the fourth electrode member 46. Therefore, the intensity of the lens diverging in the horizontal direction becomes weaker for the outer electron beams than for the center electron beam. Therefore, the lens for correcting the field curvature exhibits a stronger focusing force in the horizontal direction for the outer electron beams than for the center electron beam.

Accompanying an increase in the difference between the first focus voltage (Vf1) applied to the first type of focus electrode group and the second focus voltage (Vf2+dVf) applied to the second type of focus electrode group, therefore, the lens for correcting the field curvature formed between the third electrode member 45 and the fourth electrode member 46 works similarly to an electron lens having a ratio of the diameter of the lens for the outer electron beam in the vertical direction to the diameter thereof in the horizontal direction, which is smaller than a ratio of the diameter of the lens for the center electron beam in the vertical direction to the diameter thereof in the horizontal direction.

In the electrostatic quadrupole lens constituted between the second electrode member 44 and the third electrode member 45, the first type of focus electrode group has a potential higher than that of the second type of focus electrode group at all times. Therefore, the potential of the third electrode member 45 becomes higher than the potential of the second electrode member 44 at all times. Therefore, the electrostatic quadrupole lens constituted between the second electrode member 44 and the third electrode member 45 works to focus the electron beam in the vertical direction and to diverge it in the horizontal direction. Besides, a relationship a1<a2 exists between a gap a1 of the vertical plate electrodes sandwiching the outer electron beam in the horizontal direction and a gap a2 of the vertical plate electrodes sandwiching the center electron beam in the horizontal direction. Therefore, the lens for the outer electron beam exhibits a diverging force in the horizontal direction which is stronger than the diverging force in the horizontal direction of the lens for the center electron beam. That is, the intensity of the lens for the outer electron beam becomes stronger than the intensity of the lens for the center electron beam.

Accompanying an increase in the difference between the first focus voltage applied to the first type of focus electrode group and the second focus voltage applied to the second type of focus electrode group, therefore, the electrostatic quadrupole lens formed between the second electrode member 44 and the third electrode member 45 works similarly to an electron lens having a ratio of the diameter of the lens for the outer electron beam in the vertical direction to the diameter thereof in the horizontal direction, which is larger than a ratio of the diameter of the lens for the center electron beam in the vertical direction to the diameter thereof in the horizontal direction. That is, when the difference is great between the first focus voltage and the second focus voltage, the ratio of the diameters of the electron beams in the vertical direction to the diameters thereof in the horizontal direction (diameter in the vertical direction/diameter in the horizontal direction) is such that the center electron beam is greater than the outer electron beams (center electron beam>outer electron beams).

Therefore, imbalance in the focusing force acting on the center electron beam and on the outer electron beams in the horizontal direction, due to the lens for correcting the field curvature formed between the third electrode member 45 and the fourth electrode member 46, is canceled by the electrostatic quadrupole lens in order to eliminate spot-like imbalance of the center electron beam and of the outer electron beams on the screen, making it possible to obtain an excellent resolution.

The constitution shown in FIG. 3 can be applied to the electron gun shown in FIG. 2 to obtain the same effects. Such electrodes including a pair of horizontal plate electrodes can be easily produced.

Figure 4:
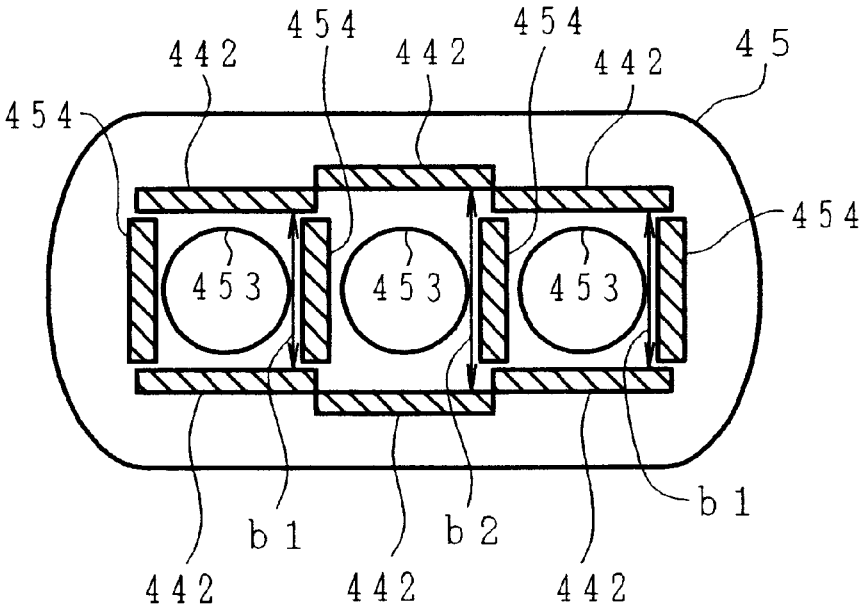
FIG. 4 is a sectional view illustrating a second constitution of the electrostatic quadrupole lens according to the first embodiment of the present invention.

FIG. 4 is a diagram illustrating a second constitution of the electrostatic quadrupole lens according to the first embodiment, and is a sectional view along the lines III—III and IV—IV in FIGS. 1 and 2.

FIG. 4 illustrates the structure of the electrostatic quadrupole lens formed between the second electrode member 44 and the third electrode member 45. Three electron beam passage holes 441 corresponding to the three electron beams are formed in the second electrode member 44 on the side of the third electrode member 45, and horizontal plate electrodes 442 extending toward the third electrode member 45 are provided on the upper and lower sides of the electron beam passage holes in the vertical direction.

Furthermore, three electron beam passage holes 453 corresponding to the three electron beams are formed in the third electrode member 45 on the side of the second electrode member 44, and vertical plate electrodes 454 extending toward the second electrode member 44 are provided, sandwiching the electron beams from both sides in the horizontal direction.

There further exists a relationship b1<b2 between a gap b1 of the horizontal plate electrodes sandwiching the outer electron beams 9 in the vertical direction and a gap b2 of the horizontal plate electrodes sandwiching the center electron beam in the vertical direction. Since there exists the relationship b1<b2 between the gap b1 of the horizontal plate electrodes sandwiching the outer electron beams in the vertical direction and the gap b2 of the horizontal plate electrodes sandwiching the center electron beam in the vertical direction, the intensity of the lens becomes stronger for the outer electron beams than for the center electron beam.

That is, when the difference is great between the first focus voltage and the second focus voltage, the ratio of the diameters of the electron beams (diameter in the vertical direction/diameter in the horizontal direction) becomes such that the center electron beam>outer electron beams, whereby the dynamic voltage is lowered, a change in the STC decreases, spot-like imbalance of the electron beams is eliminated on the screen, and a favorable resolution is obtained on the whole screen.

The constitution shown in FIG. 4 can be applied to the electron gun shown in FIG. 2 to obtain similar effects. In the structure shown in FIG. 4, furthermore, the plate electrodes are remote from the electron beam passage holes. Therefore, the electron beam passage holes are little deformed by the provision of the plate electrodes. Besides, the structure can be easily produced.

Figure 5:
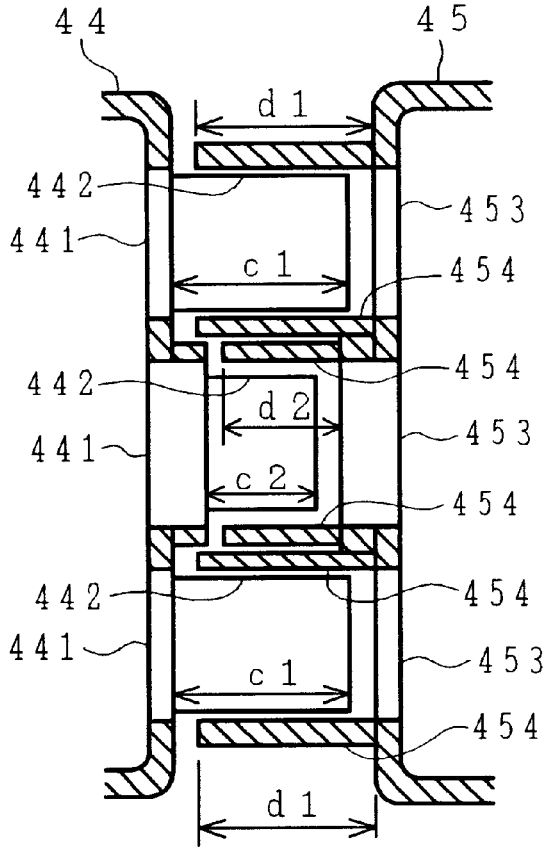
FIG. 5 is a sectional view in a horizontal direction for illustrating a third constitution of the electrostatic quadrupole lens according to the first embodiment of the present invention.

FIG. 5 is a diagram illustrating a third constitution of the electrostatic quadrupole lens according to the first embodiment and is a sectional view in the horizontal direction of FIGS. 1 and 2.

FIG. 5 illustrates the structure of the electrostatic quadrupole lens formed between the second electrode member 44 and the third electrode member 45. Three electron beam passage holes 441 corresponding to the three electron beams are formed in the second electrode member on the side of the third electrode member 45, and horizontal plate electrodes 442 extending toward the third electrode member 45 are provided on the upper and lower sides of the electron beam passage holes in the vertical direction. Furthermore, three electron beam passage holes 453 corresponding to the three electron beams are formed in the third electrode member 45 on the side of the second electrode member 44 and vertical plate electrodes 454 extending toward the second electrode member 44 are formed to sandwich the electron beam passage holes from both sides in the horizontal direction.

When the length of the horizontal plate electrodes sandwiching the outer electron beams in the axial direction of the tube is denoted by c1, the length of the horizontal plate electrodes sandwiching the center electron beam in the axial direction of the tube is denoted by c2, the length of the vertical plate electrodes sandwiching the outer electron beams in the axial direction of the tube is denoted by d1, and the length of the vertical plate electrodes sandwiching the center electron beam in the axial direction of the tube is denoted by d2, then, the electrodes forming the electrostatic quadrupole lens have a relationship c1>c2 or d1>d2, or c1>c2 and d1>d2.

Since there exists a relationship c1>c2 or d1>d2, or c1>c2 and d1>d2 among the length c1 of the horizontal plate electrodes sandwiching the outer electron beams in the axial direction of the tube, the length c2 of the horizontal plate electrodes sandwiching the center electron beam in the axial direction of the tube, the length d1 of the vertical plate electrodes sandwiching the outer electron beams in the axial direction of the tube, and the length d2 of the vertical plate electrodes sandwiching the center electron beam in the axial direction of the tube, the lens produces a stronger intensity for the outer electron beams than for the center electron beam.

That is, when the difference is great between the first focus voltage and the second focus voltage, the ratio of the diameters of the electron beams (diameter in the vertical direction/diameter in the horizontal direction) becomes such that the center electron beam>outer electron beams, whereby the dynamic voltage is lowered, a change in the STC decreases, spot-like imbalance of the electron beams is eliminated on the screen, and a favorable resolution is obtained on the whole screen.

The constitution shown in FIG. 5 can be applied to the electron gun shown in FIG. 2 to obtain similar effects. In the structure shown in FIG. 5, furthermore, the plate electrodes are overlapped in small amounts making it possible to increase the breakdown voltage.

Figure 6:
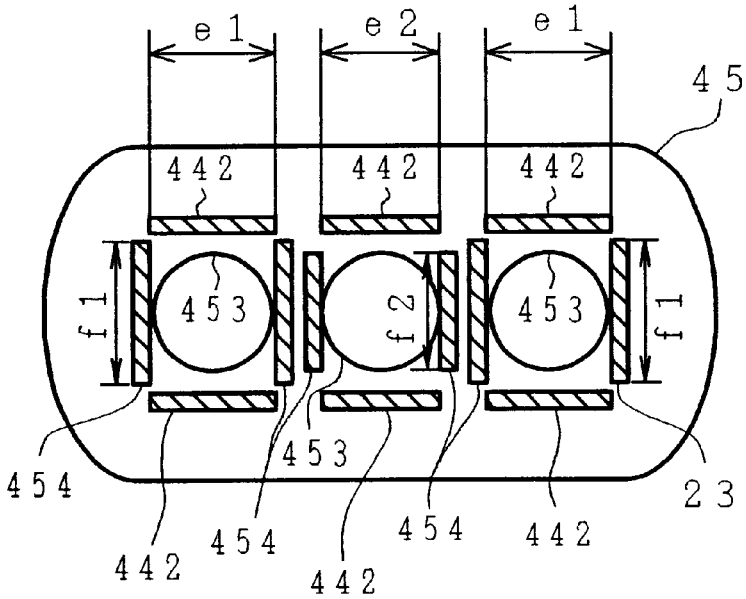
FIG. 6 is a sectional view illustrating a fourth constitution of the electrostatic quadrupole lens according to the first embodiment.

FIG. 6 is a diagram illustrating a fourth constitution of the electrostatic quadrupole lens according to the first embodiment and is a sectional view along the lines III—III and IV—IV in FIGS. 1 and 2.

FIG. 6 illustrates the structure of the electrostatic quadrupole lens formed between the second electrode member 44 and the third electrode member 45. Three electron beam passage holes 441 corresponding to the three electron beams are formed in the second electrode member 44 on the side of the third electrode member 45 as shown in FIG. 1, and horizontal plate electrodes 442 extending toward the third electrode member 45 are provided on the upper and lower sides of the electron beam passage holes in the vertical direction. Furthermore, three electron beam passage holes 453 corresponding to the three electron beams are formed in the third electrode member 45 on the side of the second electrode member 44, and vertical electrode pieces 454 extending toward the second electrode member 44 are provided to sandwich the electron beam passage holes from both sides in the horizontal direction.

When the width of the horizontal plate electrodes sandwiching the outer electron beams 9 in the horizontal direction is denoted by e1, the width of the horizontal plate electrodes sandwiching the center electron beam in the horizontal direction by e2, the width of the vertical plate electrodes sandwiching the outer electron beams in the vertical direction by f1, and the width of the vertical plate electrodes sandwiching the center electron beam in the vertical direction by f2, the electrodes forming the electrostatic quadrupole lens have a relationship e1>e2 or f1 >f2, or e1>e2 and f1>f2.

Since there exists a relationship e1>e2 or f1>f2, or e1>e2 and f1>f2 among the width e1 of the horizontal plate electrodes sandwiching the outer electron beams in the horizontal direction, the width e2 of the horizontal plate electrodes sandwiching the center electron beam in the horizontal direction, the width f1 of the vertical plate electrodes sandwiching the outer electron beams in the vertical direction, and the width f2 of the vertical plate electrodes sandwiching the center electron beam in the vertical direction, the lens produces a stronger intensity for the outer electron beams than for the center electron beam.

That is, when the difference is great between the first focus voltage and the second focus voltage, the ratio of the diameters of the electron beams (diameter in the vertical direction/diameter in the horizontal direction) becomes such that the center electron beam>outer electron beams, whereby the dynamic voltage is lowered, a change in the STC decreases, spot-like imbalance of the electron beams is eliminated on the screen, and a favorable resolution is obtained on the whole screen.

The constitution shown in FIG. 6 can be applied to the electron gun shown in FIG. 2 to obtain similar effects. In the structure shown in FIG. 6, furthermore, the size of the vertical plate electrodes can be decreased.

Figure 7:
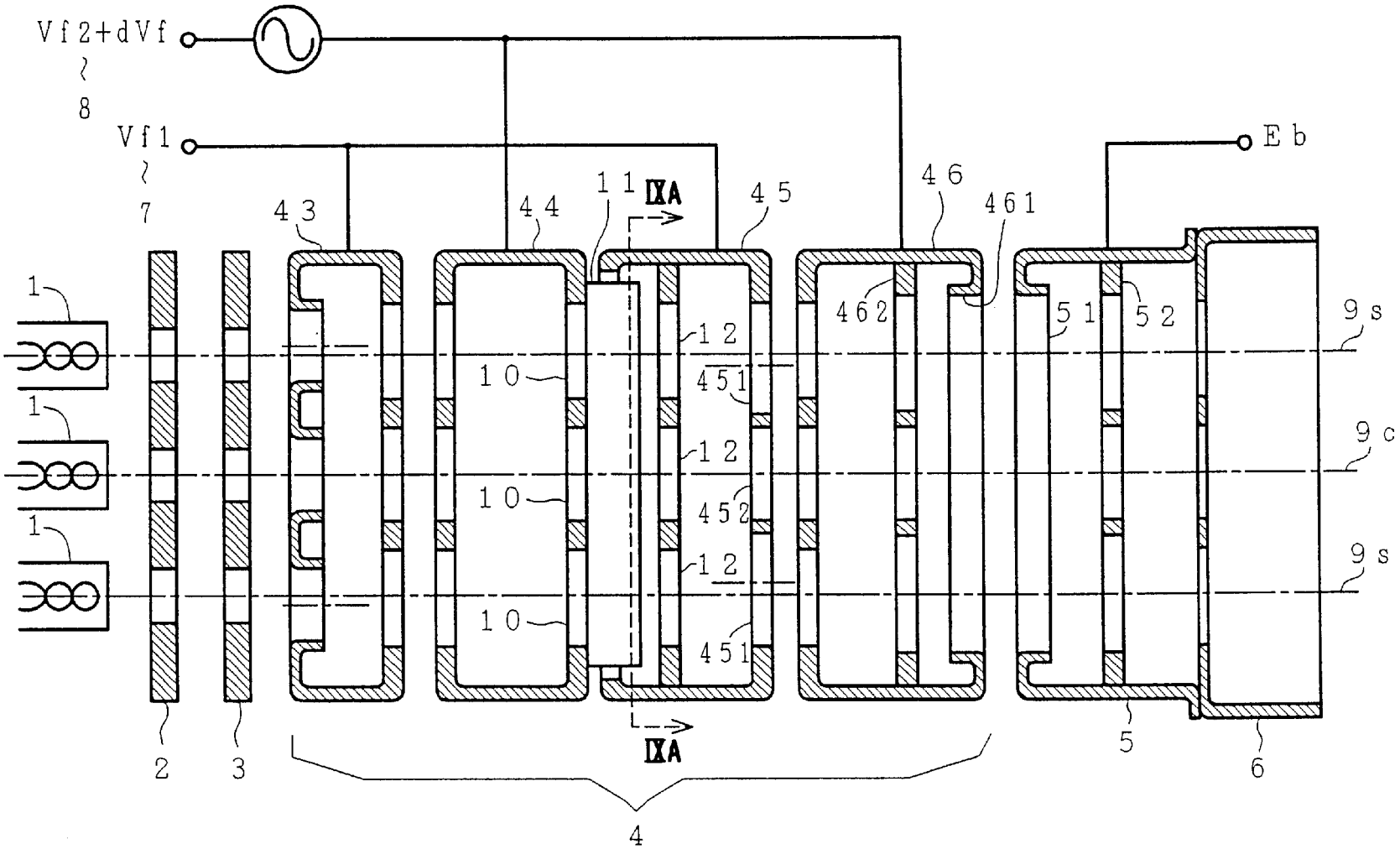
FIG. 7 is a sectional view illustrating a main lens in the electron gun of a further structure according to the first embodiment of the present invention.
Figure 8:
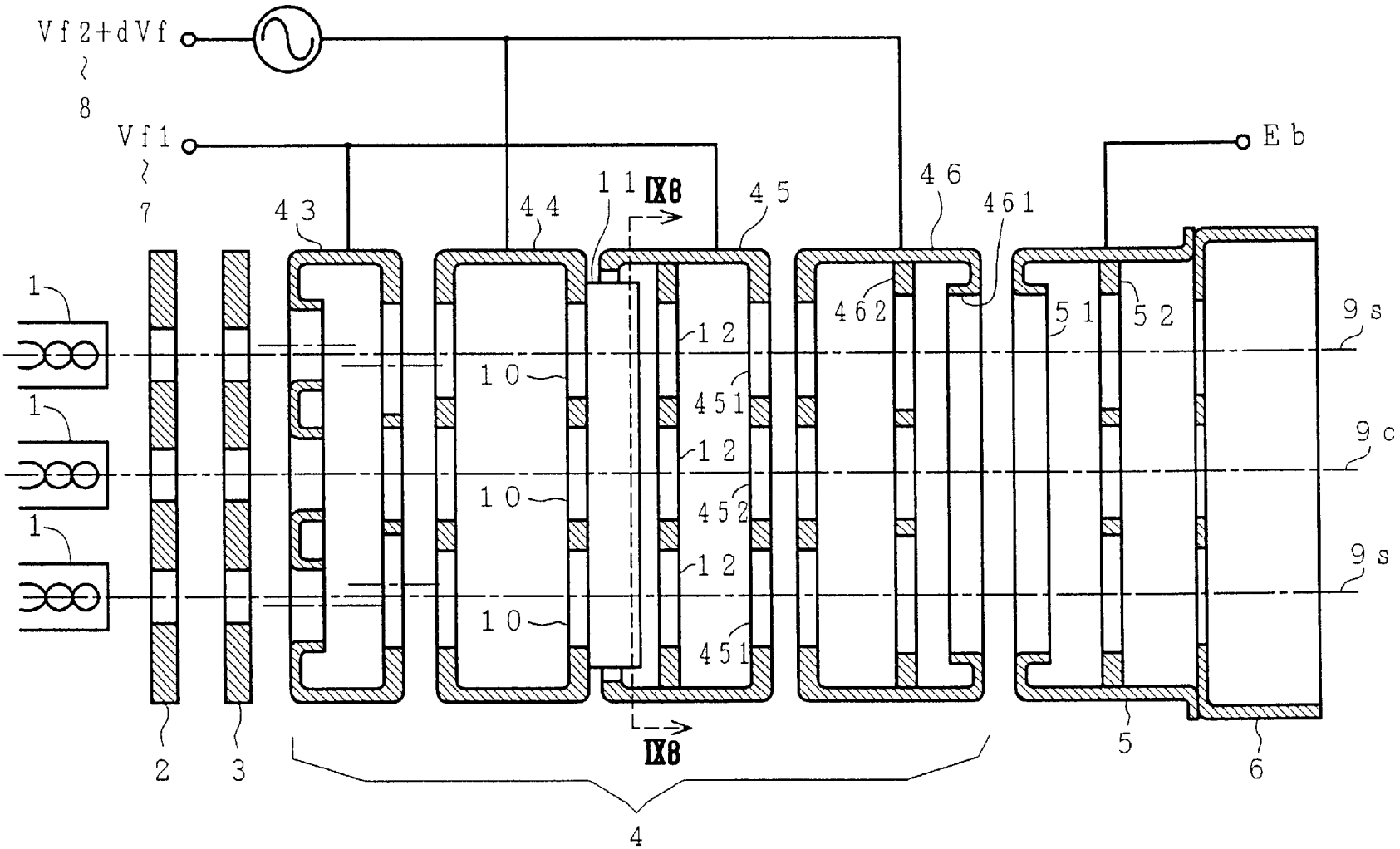
FIG. 8 is a sectional view of the main lens of the electron gun of a still further structure according to the first embodiment of the present invention.
Figure 9:
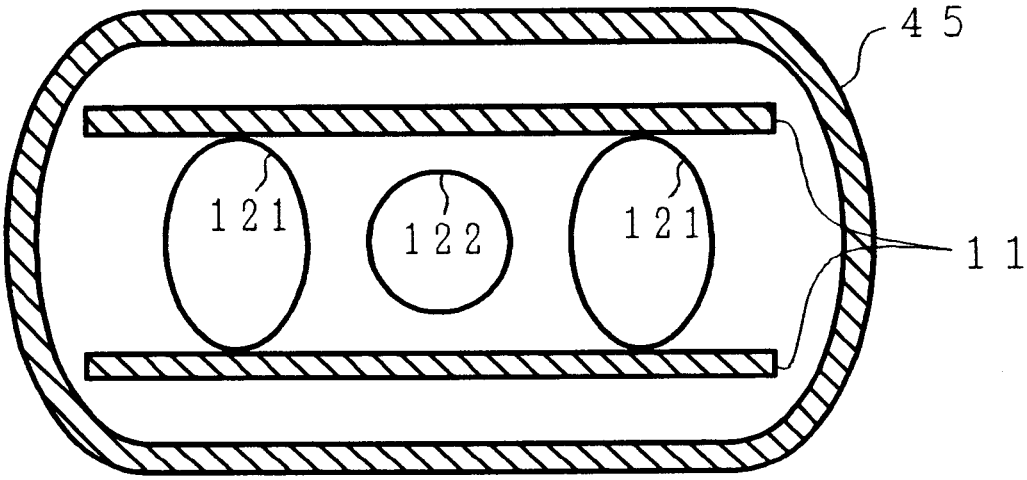
FIG. 9 is a sectional view illustrating a fifth constitution of the electrostatic quadrupole lens according to the first embodiment.

FIGS. 7 and 8 are sectional views illustrating a major portion of another constitution of the electron gun according to the first embodiment, and FIG. 9 is a sectional view along the line IXA—IXA and IXB—IXB of FIGS. 7 and 8 to explain the constitution of the electrostatic quadrupole lens and illustrate a fifth constitution of the first embodiment.

The electron gun shown in FIGS. 7 and 8 works to correct the convergence between the accelerating electrode 3 and the focus electrode 4, and in which the center axes of the outer sides of the accelerating electrode 3 are deviated from the center axes of the outer sides of the first electrode member 43. The center axes of the outer sides of the first electrode member 43 are deviated toward the direction opposite to the center axis at the center in the in-line direction, in order to correct the trajectories of the outer electron beams toward a direction to approach the center electron beam. In the electrodes forming the main lens, furthermore, a distance between the center axis 9C and the center axis of the outer beam passage hole among the three electron beam passage holes formed in the electrode plate 462 is set to be equal to a distance between the center axis 9C of the center beam passage hole and the center axis of the outer beam passage hole among the three electron beam passage holes formed in the electrode plate 52.

The main lens exhibits the STC action even when the center axes of the outer holes of the two electrodes constituting the main lens are concentric as shown in FIGS. 7 and 8. Therefore, when the focus voltage applied to the focus electrode opposed to the anode 5 and which forms the main lens changes in synchronism with a change in the deflection angle for scanning the electron beams on the screen, the intensity of the main lens formed by the anode 5 and by the fourth focus electrode 46 undergoes a change, whereby the STC action of the main lens changes.

In FIG. 7, the center axes of the outer electron beam passage holes of the third electrode member 45 are deviated from the center axes of the outer electron beam passage holes of the fourth electrode member 46. In this case, the outer electron beam passage holes of the fourth electrode member 46 are in agreement with the center axes 9S of the outer sides, and the center axes of the outer electron beam passage holes of the third electrode member 45 are inwardly deviated relative to the center axes 9S of the outer sides.

Between the third electrode member 45 and the fourth electrode member 46, therefore, the substantial centers of the outer electron beam passage holes 451 of the third electrode member 45 on the side of the fourth electrode member 4G are deviated on a horizontal plane toward the center electron beam passage hole 452 relative to the outer electron beams.

In FIG. 8, the center axes of the outer electron beam passage holes of the first electrode member 43 are deviated from the center axes of the outer electron beam passage holes of the second electrode member 44. In this case, the outer electron beam passage holes of the second electrode member 44 are in agreement with the center axes 9S of the outer sides, and the center axes of the outer electron beam passage holes of the first electrode member 43 are inwardly deviated relative to the center axes 9S of the outer sides.

Between the first electrode member 43 and the second electrode member 44, therefore, the substantial centers of the outer electron beam passage holes of the first electrode member 43 on the side of the second electrode member 44 are deviated toward the center electron beam passage hole on a horizontal plane.

This electron gun has an electrostatic quadrupole lens with a structure different from that of the above-mentioned electron gun.

FIGS. 7 and 8 are sectional views of the electron gun forming the electrostatic quadrupole lens by inserting horizontal plate electrodes in a tubular electrode to sandwich the three electron beams from the upper and lower sides. In FIGS. 7 and 8, the same portions are denoted by the same reference numerals.

In FIGS. 7, 8 and 9, three electron beam passage holes 10 corresponding to the three electron beams are formed in the second electrode member 44 on the side of the third electrode member 45, and horizontal plate electrodes 11 extending toward the third electrode member 45 are connected thereto on the upper and lower sides of the electron beam passage holes in the vertical direction. Moreover, three electron beam passage holes 12 (121, 122, 121) corresponding to the three electron beams are formed in the third electrode member 45 on the side of the second electrode member 44.

Moreover, a ratio of the diameter of the outer electron beam passage holes 121 in the third electrode member 45 on the side of the second electrode member 44 in the vertical direction to the diameter thereof in the horizontal direction is set to be larger than a ratio of the diameter of the center electron beam passage hole 122 in the vertical direction to the diameter thereof in the horizontal direction.

The ratio of the diameter of the outer electron beam passage holes in the third electrode member 45 on the side of the second electrode member 44 in the vertical direction to the diameter thereof in the horizontal direction is greater than the ratio of the diameter of the center electron beam passage hole in the vertical direction to the diameter thereof in the horizontal direction. Therefore, the lens produces a stronger intensity for the outer electron beams than for the center electron beam.

That is, when the difference is great between the first focus voltage and the second focus voltage, the ratio of the diameters of the electron beams (diameter in the vertical direction/diameter in the horizontal direction) becomes such that the center electron beam >outer electron beams, whereby the dynamic voltage is lowered, a change in the STC decreases, spot-like imbalance of the electron beams is eliminated on the screen, and a favorable resolution is obtained on the whole screen.

Moreover, since the convergence can be adjusted by the electron lens formed by the third electrode member 45 and the fourth electrode member 46, the electron lens formed by the second electrode member 44 and the third electrode member 45 can be adjusted by the action of the electrostatic quadrupole lens alone; i.e., the electrostatic quadrupole lens produces a stronger action.

Figure 10:
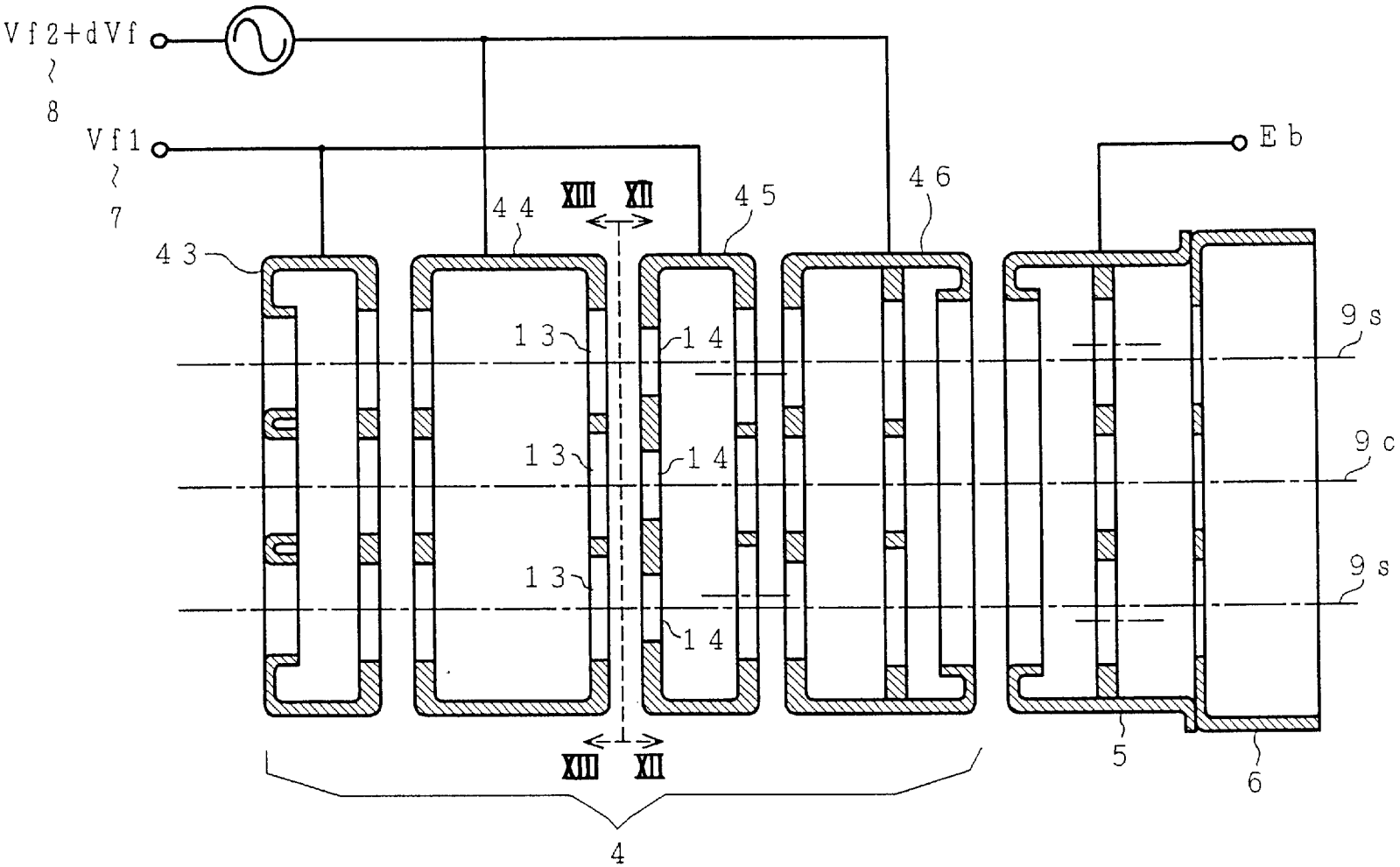
FIG. 10 is a sectional view of the main lens in the electron gun of a yet further structure according to the first embodiment of the present invention.
Figure 11:
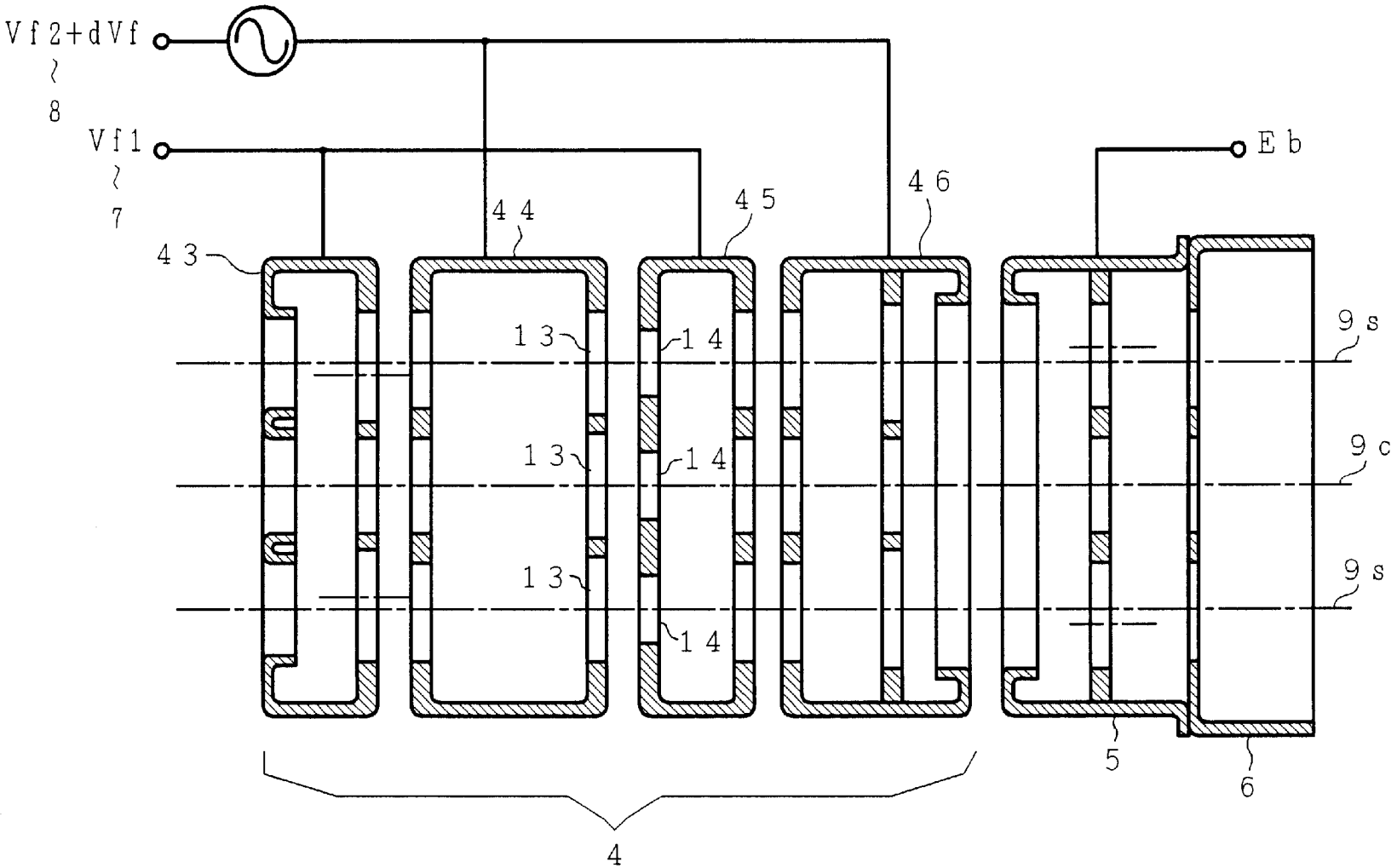
FIG. 11 is a sectional view of the main lens in the electron gun of a further structure according to the first embodiment of the present invention.

FIGS. 10 and 11 are sectional views illustrating a major portion of the main lens for illustrating a further constitution of the electron gun according to the first embodiment.

In FIG. 10, the center axes of the outer electron beam passage holes in the third electrode member 45 are deviated from the center axes of the outer electron beam passage holes in the fourth electrode member 46. In this case, the outer electron beam passage holes in the fourth electrode member 46 are in agreement with the axes 9S of the outer sides, and the center axes of the outer electron beam passage holes in the third electrode member 45 are inwardly deviated relative to the center axes 9S of the outer sides.

Between the third electrode member 45 and the fourth electrode member 46, therefore, substantial centers of the outer electron beam passage holes 451 in the third electrode member 45 on the side of the fourth electrode member 46 are deviated toward the center electron beam passage hole 452 relative to the outer electron beams on a horizontal plane.

In FIG. 11, the center axes of the outer electron beam passage holes in the first electrode member 43 are deviated from the center axes of the outer electron beam passage holes in the second electrode member 44. In this case, the outer electron beam passage holes in the second electrode member 44 are in agreement with the axes 9S of the outer sides, and the center axes of the outer electron beam passage holes in the first electrode member 43 are inwardly deviated relative to the center axes 9S of the outer sides.

Between the first electrode member 43 and the second electrode member 44, therefore, substantial centers of the outer electron beam passage holes in the first electrode member 43 on the side of the second electrode member 44 are deviated toward the center electron beam passage hole on a horizontal plane.

This electron gun has an electrostatic quadrupole lens structure different from that of the above-mentioned electron gun. The electrostatic quadrupole lens shown in FIGS. 12 and 13 represents a sixth constitution of the first embodiment.

FIGS. 10 and 11 are sectional views of the electron gun forming the electrostatic quadrupole lens by forming vertically elongated electron beam passage holes in one of the opposing electrodes and by forming laterally elongated electron beam passage holes in the other one. In FIGS. 10 and 11, the same portions are denoted by the same reference numerals.

In these electron guns, three electron beam passage holes 13 (131, 132, 131) corresponding to the three electron beams are formed in the second electrode member 44 on the side of the third electrode member 45, and three electron beam passage holes 14 (141, 142, 141) corresponding to the three electron beams are formed in the third electrode member 45 on the side of the second electrode member 44.

Figure 12:
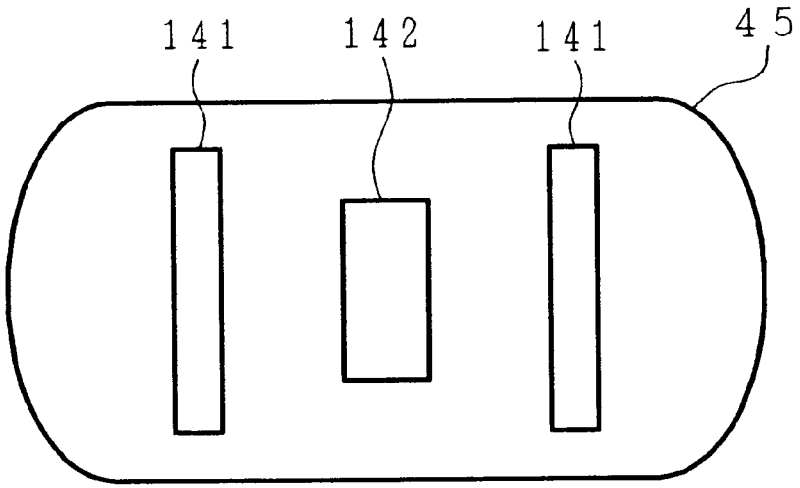
FIG. 12 is a sectional view illustrating a sixth constitution of the electrostatic quadrupole lens according to the first embodiment.
Figure 13:
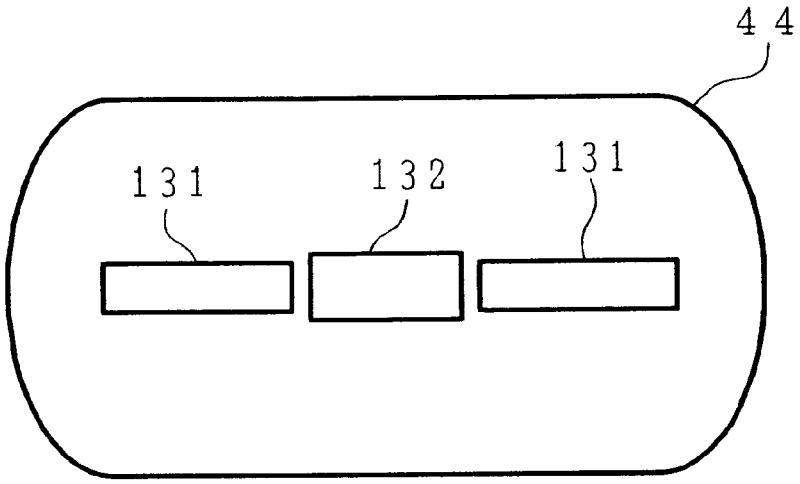
FIG. 13 is a sectional view illustrating the sixth constitution of the electrostatic quadrupole lens according to the first embodiment.

FIG. 12 is a sectional view along the line XII—XII in FIG. 10, and illustrates the constitution of the electrostatic quadrupole lens, showing electron beam passage holes formed in the third electrode member 45.

A ratio of the diameter of the outer electron beam passage holes 141 in the third electrode member 45 on the side of the second electrode member 44 in the vertical direction to the diameter thereof in the horizontal direction, is larger than a ratio of the diameter of the center electron beam passage hole 142 in the vertical direction to the diameter thereof in the horizontal direction.

FIG. 13 is a sectional view along the line XII—XII in FIG. 10, and shows electron beam passage holes in the second electrode member 44 forming the electrostatic quadrupole lens.

Three electron beam passage holes 13 (131, 132, 131) corresponding to the three electron beams are formed in the second electrode member 44 on the side of the third electrode member 45, and three electron beam passage holes 14 (141, 142, 141) corresponding to the three electron beams are formed in the third electrode member 45 on the side of the second electrode member 44.

Moreover, a ratio of the diameter of the outer electron beam passage holes 131 in the second electrode member 44 on the side of the third electrode member 45 in the vertical direction to the diameter thereof in the horizontal direction is set to be smaller than a ratio of the diameter of the center electron beam passage hole 132 in the vertical direction to the diameter thereof in the horizontal direction.

A ratio of the diameter of the outer electron beam passage holes in the second electrode member 44 on the side of the third electrode member 45 in the vertical direction to the diameter thereof in the horizontal direction is smaller than a ratio of the diameter of the center electron beam passage hole in the vertical direction to the diameter thereof in the horizontal direction; and, besides, a ratio of the diameter of the outer electron beam passage holes 141 in the third electrode member 45 on the side of the second electrode member 44 in the vertical direction to the diameter thereof in the horizontal direction is larger than a ratio of the diameter of the center electron beam passage hole 142 in the vertical direction to the diameter thereof in the horizontal direction. Therefore, the lens produces a stronger intensity for the outer electron beams than for the center electron beam.

That is, when the difference is great between the first focus voltage and the second focus voltage, the ratio of the diameters of the electron beams (diameter in the vertical direction/diameter in the horizontal direction) becomes such that the center electron beam>outer electron beams, whereby the dynamic voltage is lowered, a change in the STC decreases, spot-like imbalance of the electron beams is eliminated on the screen, and a favorable resolution is obtained on the screen.

Moreover, the electrodes can be easily formed since the electrostatic quadrupole lens is formed with the electron beam passage holes and the electron beam passage holes abutted together.

FIGS. 14*a* to 16*b* illustrate a seventh constitution according to the first embodiment, in which imbalanced focusing by the lens for correcting the field curvature that works to correct a change in the STC is corrected by another lens for correcting the curvature in the image field.

FIGS. 14*a* and 14*b*, FIGS. 15*a* and 15*b*, and FIGS. 16*a* and 16*b*, are diagrams of opposing surfaces of the lens for correcting the field curvature without the action for correcting a change in the STC, and show the electron beam passage holes.

Figure 14A:
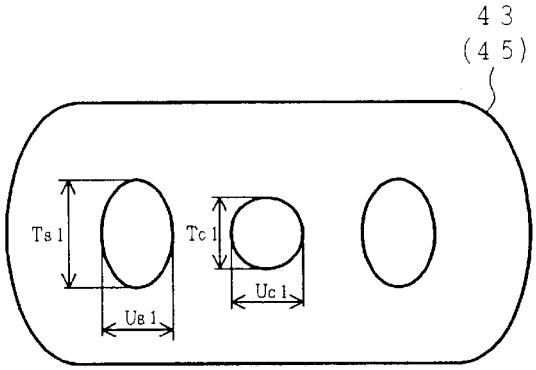
FIGS. 14*a* and 14*b* are sectional views illustrating a seventh constitution of a lens for correcting the field curvature according to the first embodiment.
Figure 14B:
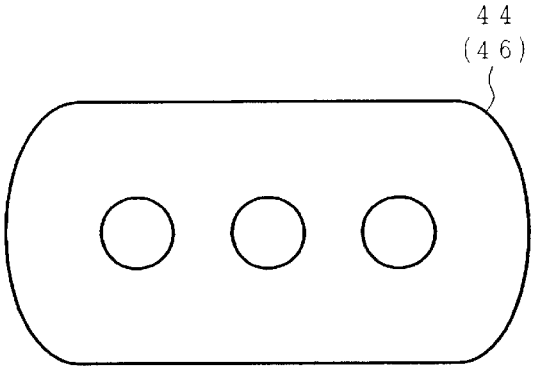
Figure 15A:
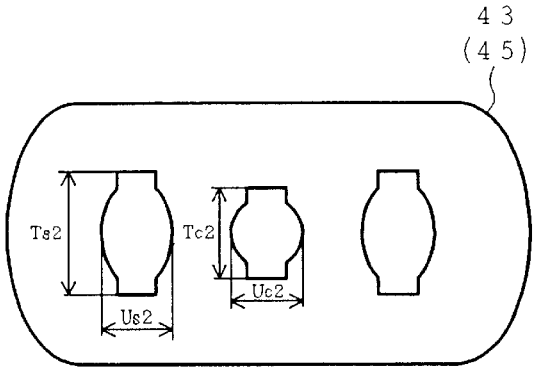
FIGS. 15*a* and 15*b* are sectional views illustrating the seventh constitution of the lens for correcting the field curvature according to the first embodiment.
Figure 15B:
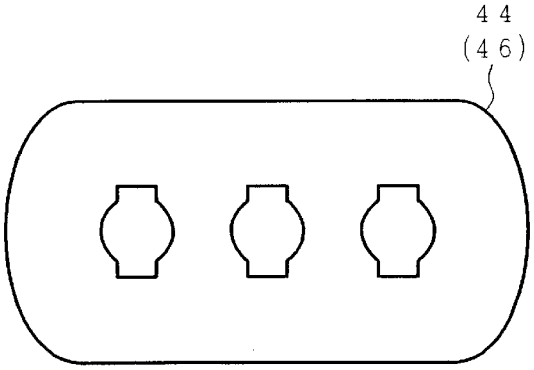
Figure 16A:
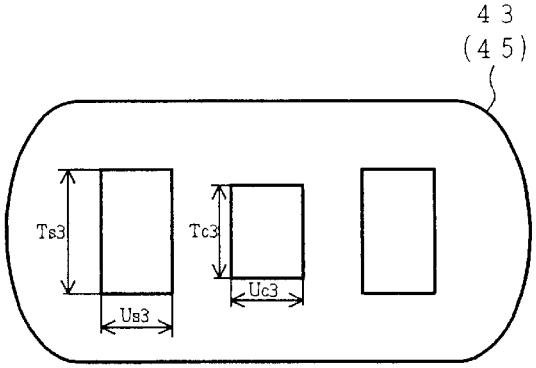
FIGS. 16*a* and 16*b* are sectional views illustrating the seventh constitution of the lens for correcting the field curvature according to the first embodiment.
Figure 16B:
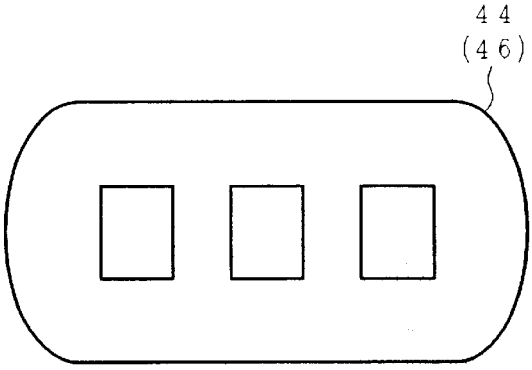

FIGS. 14*a*, 15*a* and 16*a* show electron beam passage holes formed in the first electrode member 43 on the side of the second electrode member in FIG. 1. FIGS. 14*b*, 15*b* and 16*b* show electron beam passage holes formed in the second electrode member 44 on the side of the first electrode member in FIG. 1. The electron beam passage holes in the first electrode member 43 and the electron beam passage holes in the second electrode member 44 are in agreement with the center axes 9 (9C, 9S). The electron beam passage holes in the first electrode member 43 have a ratio (diameter in the vertical direction/diameter in the horizontal direction) of the diameter of the outer electron beam passage holes in the vertical direction to the diameter thereof in the horizontal direction, which is larger than a ratio (diameter in the vertical direction/diameter in the horizontal direction) of the center electron beam passage hole in the vertical direction to the diameter thereof in the horizontal direction (ratio of the outer electron beam passage holes>ratio of the center electron beam passage hole).

Besides, the electron beam passage holes in the second electrode member 44 on the side of the first electrode member are all of the same shape, which is the same as the shape of the center beam passage hole in the first electrode member 43 on the side of the second electrode member. Moreover, the electron beam passage holes in the second electrode member 44 on the side of the first electrode member and the electron beam passage holes in the first electrode member 43 on the side of the second electrode member are all of the same diameter in the horizontal direction. Therefore, the lens for the outer electron beams controls the focusing force in the vertical direction only.

The lens produces a stronger focusing action for the outer electron beams in the vertical direction than for the center electron beam in the vertical direction.

That is, when the difference is great between the first focus voltage and the second focus voltage, the ratio of the diameters of the electron beams (diameter in the vertical direction diameter in the horizontal direction) becomes such that the center electron beam>outer electron beams, whereby the dynamic voltage is lowered, a change in the STC decreases, spot-like imbalance of the electron beams is eliminated on the screen, and a favorable resolution is obtained on the screen.

As for the electron beam passage holes shown in FIG. 14*a*, the outer electron beam passage holes are elongated in the vertical direction. The outer electron beam passage holes have a vertical diameter Ts1, which is longer than a vertical diameter Tc1 of the center electron beam passage hole, and have a horizontal diameter Us1, which is equal to a horizontal diameter Uc1 of the center electron beam passage hole.

As for the electron beam passage holes shown in FIG. 15*a*, the outer electron beam passage holes have a vertical diameter Ts2 which is longer than a vertical diameter Tc2 of the center electron beam passage hole, and have sides without curvature at the upper and-lower portions of the electron beam passage holes. Upon forming portions without curvature, the length of the sides can be adjusted by changing the curvature of the arcuate portion, thereby to control the focusing force and, hence, to easily control the focusing force of the electron lens. The outer electron beam passage holes have a horizontal diameter Us2 which is equal to the horizontal diameter Uc2 of the center electron beam passage hole.

As for the electron beam passage holes shown in FIG. 16*a*, the outer electron beam passage holes are of a rectangular shape in the vertical direction. The outer electron beam passage holes have a vertical diameter Ts3 which is longer than a vertical diameter Tc3 of the center electron beam passage hole, and have a horizontal diameter Us3 which is equal to a horizontal diameter Uc3 of the center electron beam passage hole.

Upon applying the constitutions shown in FIGS. 14*a*, 15*a* and 16*a* to the third electrode member 45 of FIG. 2 and applying the constitutions shown in FIGS. 14*b*, 15*b* and 16*b* to the fourth electrode member 46 of FIG. 2, it is possible to decrease the dynamic voltage, to decrease a change in the STC, to eliminate spot-like imbalance of the electron beams on the screen, and to obtain a favorable resolution over the whole screen.

The lens for correcting the field curvature exhibits the action for focusing the electron beams in both the horizontal direction and the vertical direction. Therefore, the adjustment may be effected in either the horizontal direction or the vertical direction, enabling the lens to be easily produced.

Next, described below are the shapes of the electrodes for forming the lens for correcting the field curvature according to the first embodiment of the present invention. In particular, described below is the lens for correcting the field curvature that has an action for correcting a change in the STC of the main lens in the electron gun of the succeeding-stage offset structure (FIGS. 1, 7 and 10).

Figure 17A:
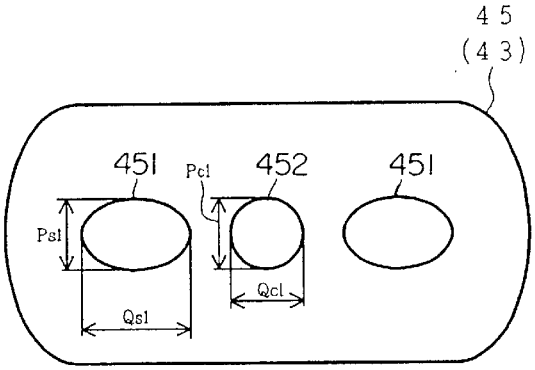
FIGS. 17*a* and 17*b* are sectional views illustrating a constitution of the lens for correcting the field curvature according to the first embodiment.
Figure 17B:
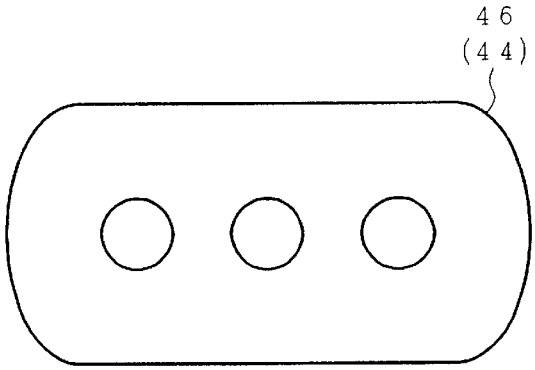

FIG. 17*a* shows the electron beam passage holes in the third electrode member 45 which is the first type of focus electrode on the side of the fourth electrode member 46, and FIG. 17*b* shows the electron beam passage holes in the fourth electrode member 46 which is the second type of focus electrode on the side of the third electrode member 45 according to the first embodiment. In this embodiment, as shown in FIG. 17*b,* the electron beam passage holes in the fourth electrode member 46 on the side of the third electrode member 45 are of the same circular shape as the center electron beam passage hole 452 in the third electrode member 45 on the side of the fourth electrode member 46. The outer electron beam passage holes 451 in the third electrode member 45 on the side of the fourth electrode member 46 have a horizontal diameter Qsl which is longer than a horizontal diameter Qc1 of the center electron beam passage hole 452, and have a vertical diameter Ps1 which is equal to a vertical diameter Pc1 of the center electron beam passage hole 452.

In an electron gun in which the third electrode member 45 and the fourth electrode member 46 are opposed to each other, and the center of the center electron beam passage hole is brought into agreement with the center axis 9C, the centers of the outer electrodes of the third electrode member 45 are inwardly deviated from the center axes 95 of the outer sides.

Figure 18A:
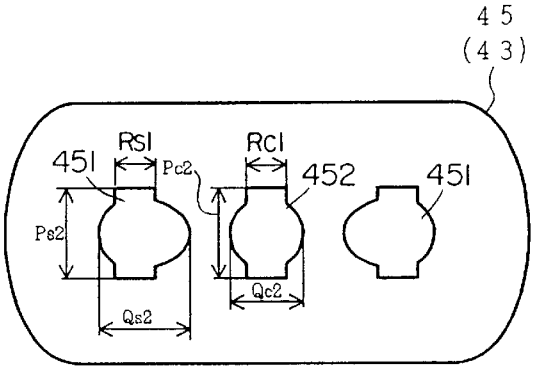
FIGS. 18*a* and 18*b* are sectional views illustrating a constitution of the lens for correcting the field curvature according to the first embodiment.
Figure 18B:
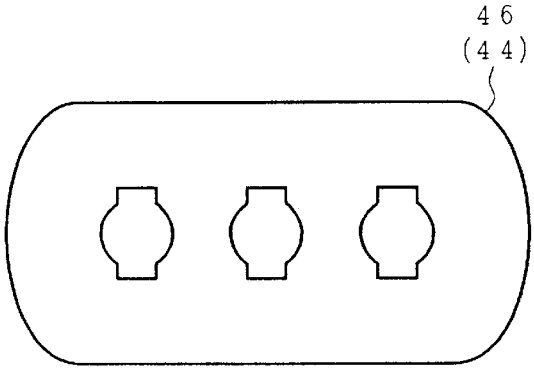

FIGS. 18*a* and 18*b* illustrate a further constitution of the electron beam passage holes in the third electrode member 45 on the side of the fourth electrode member 46, and of the electron beam passage holes in the fourth electrode member 46 on the side of the third electrode member 45 according to the first embodiment. The electron beam passage holes in the fourth electrode member 46 on the side of the third electrode member 45 shown in FIG. 18*b* are of the same shape as the center electron beam passage hole 452 in the third electrode member 45. The outer electron beam passage holes 451 shown in FIG. 18*a* have a horizontal diameter Qs2 which is longer than a horizontal diameter Qc2 of the center electron beam passage hole 452. Referring to FIG. 18*a,* the outer electron beam passage holes 451 have a vertical diameter Ps2 which is equal to a vertical diameter Pc2 of the center electron beam passage hole 452, and have a side without curvature of a width Rs1 which is equal to a width Rc1 of the side without curvature of the center electron beam passage hole 452.

In an electron gun in which the third electrode member 45 and the fourth electrode member 46 are opposed to each other, and the center of the center electron beam passage hole is brought into agreement with the center axis 9C, the centers of the outer electrodes of the third electrode member 45 are outwardly deviated from the center axes 9C of the outer sides.

Figure 19A:
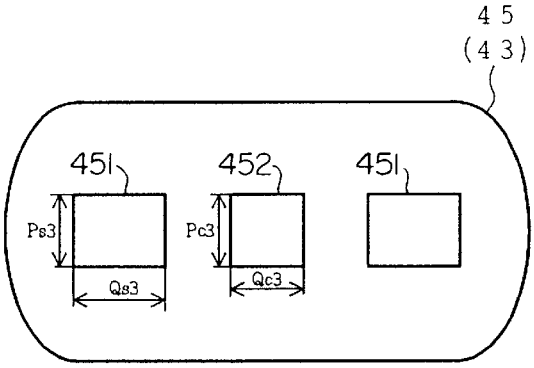
FIGS. 19*a* and 19*b* are sectional views illustrating a constitution of the lens for correcting the field curvature according to the first embodiment.
Figure 19B:
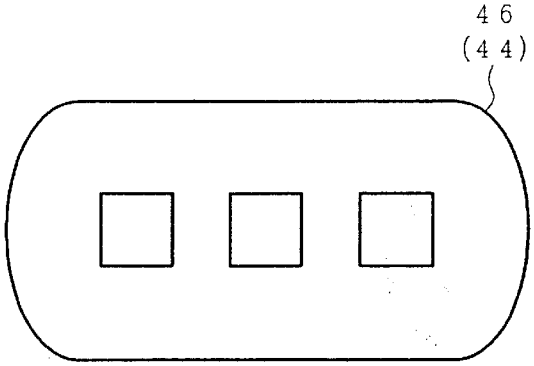

FIGS. 19*a* and 19*b* illustrate a still further constitution of the electron beam passage holes in the third electrode member 45 on the side of the fourth electrode member 46, and of the electron beam passage holes in the fourth electrode member 46 on the side of the third electrode member 45 according to the first embodiment. The electron beam passage holes in the fourth electrode member 46 on the side of the third electrode member 45 shown in FIG. 19*b* are of the same rectangular shape as the center electron beam passage hole 452 in the third electrode member 45. The outer electron beam passage holes 451 shown in FIG. 19*a* have a horizontal diameter Qs3 which is longer than a horizontal diameter Qc3 of the center electron beam passage hole 452. Referring to FIG. 19*a,* the outer electron beam passage holes 451 have a vertical diameter Ps3 which is equal to a vertical diameter Pc3 of the center electron beam passage hole 452.

In an electron gun in which the third electrode member 45 and the fourth electrode member 46 are opposed to each other, and the center of the center electron beam passage hole is brought into agreement with the center axis 9C, the centers of the outer electrodes of the third electrode member 45 are inwardly deviated from the center axes 95 of the outer sides.

The description of the lens for correcting the field curvature that acts to correct a change in the STC of the main lens is related to the succeeding-stage offset structure (FIGS. 1, 7 and 10). Here, the structure of FIGS. 17*a* to 19*b* can also be applied to the preceding-stage offset structure (FIGS. 2, 8 and 11). Referring to the electrodes for forming the lens for correcting the field curvature in the electron gun having the above-mentioned preceding-stage offset structure, the first type of focus electrode is the first electrode member 43, and the second type of focus electrode is the second focus electrode member 44.

A second embodiment deals with an electron gun in which the center axes of the outer electron beam passage holes in the first type of focus electrode are in agreement with the center axes 9S of the outer sides, and the center axes of the outer electron beam passage holes in the second type of focus electrode are outwardly deviated relative to the center axes of the outer electron beam passage holes in the first type of focus electrode.

Figure 20:
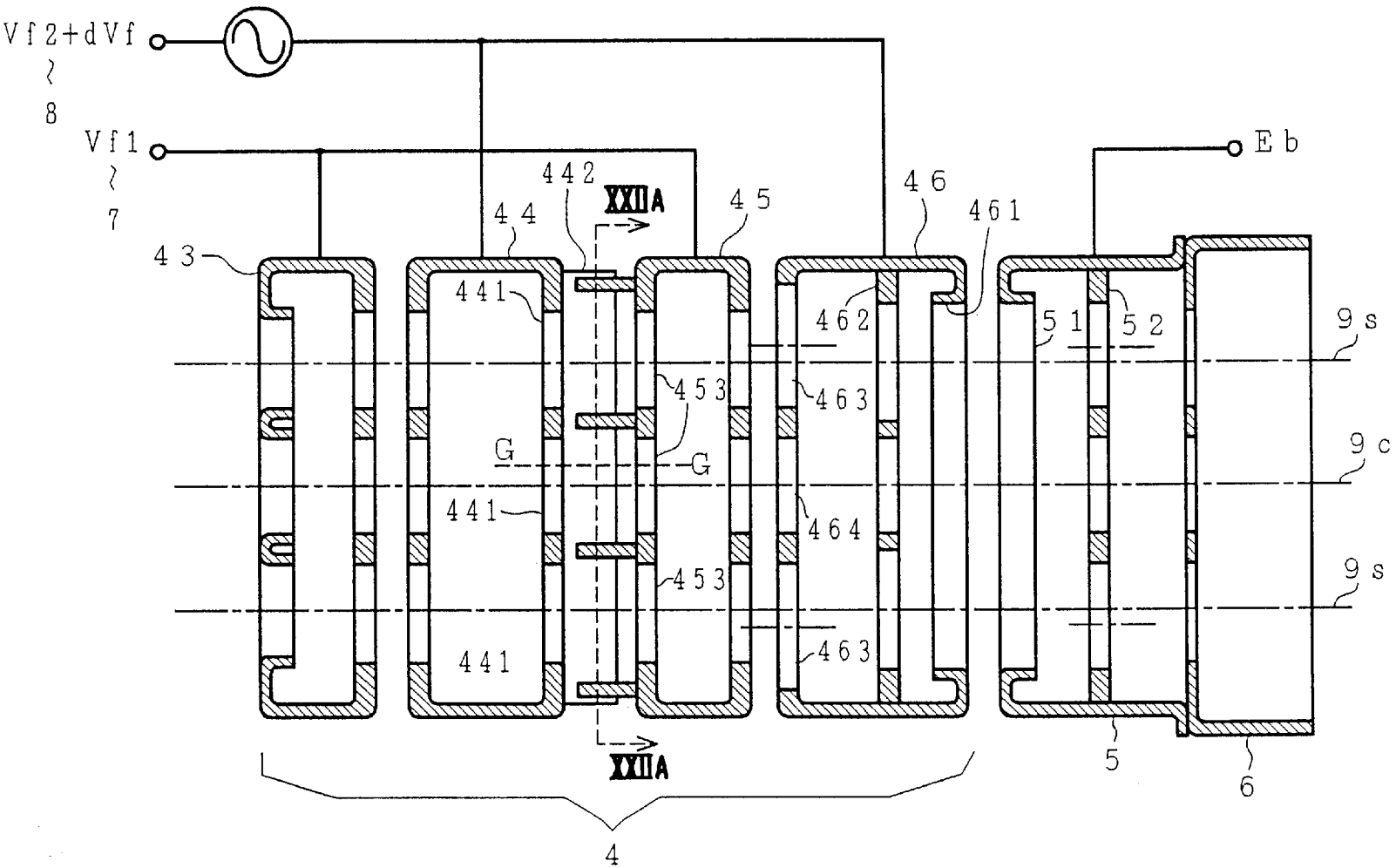
FIG. 20 is a sectional view of the main lens in the electron gun used in the color cathode-ray tube according to a second embodiment of the present invention.
Figure 21:
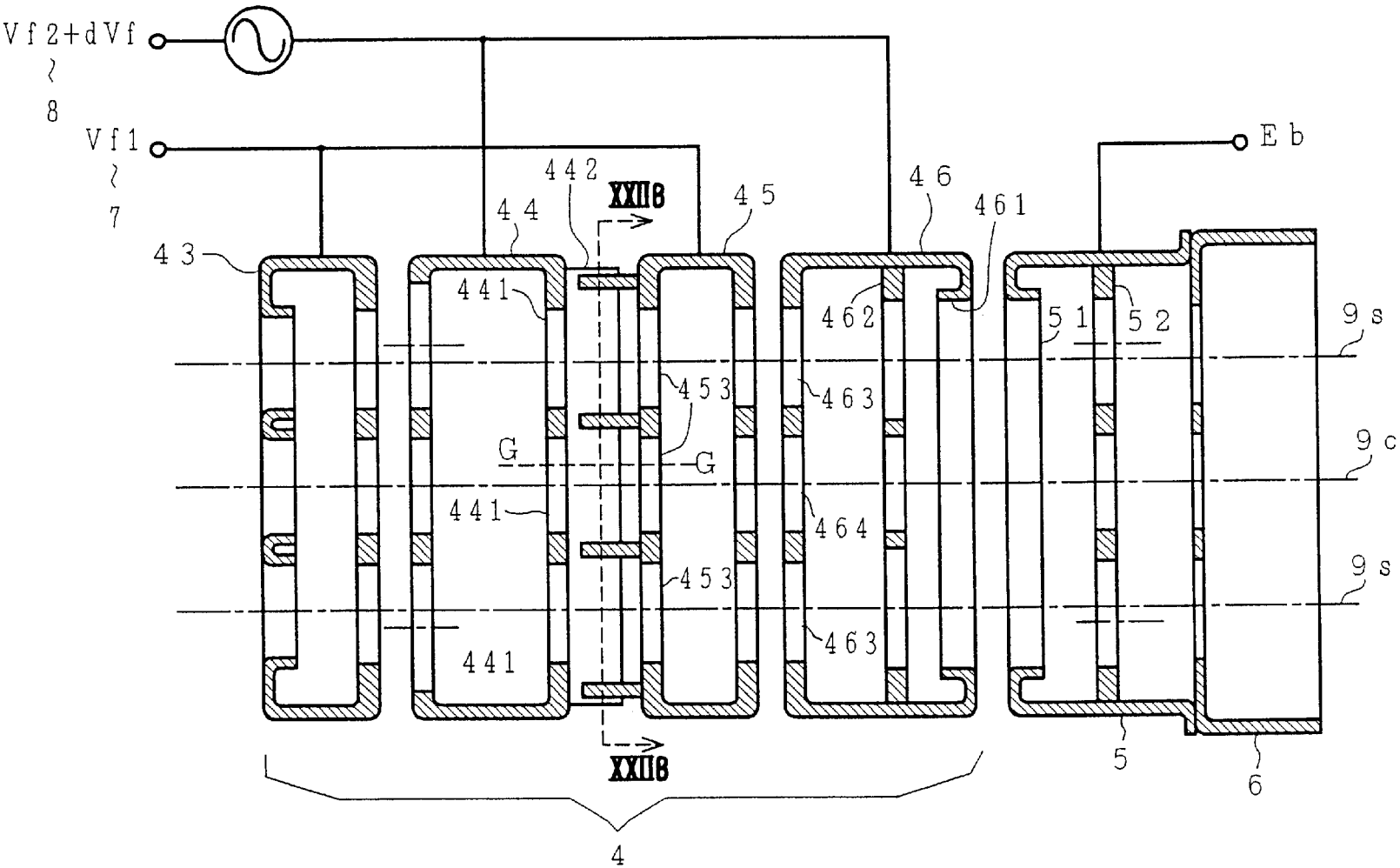
FIG. 21 is a sectional view of the main lens in the electron gun having another structure according to the second embodiment of the present invention.

FIGS. 20 and 21 are diagrams illustrating the second embodiment of the electron gun used in the color cathode-ray tube of the present invention and are section views of the main lens. FIGS. 20 and 21 are section views of the electron gun in which an electrostatic quadrupole lens is formed by using horizontal plate electrodes that sandwich the three electron beams from the upper and lower sides, and horizontal plate electrodes that sandwich the electron beams from the right and left sides.

In these drawings, reference numeral 4 denotes a focus electrode group, 5 denotes an anode, and 6 denotes a shield cup electrode. The focus electrode group 4 comprises a first electrode member 43, a second electrode member 44, a third electrode member 45, and a fourth electrode member 46. The conditions for applying the voltage and the action of the main lens are the same as those of the aforementioned electron gun shown in FIGS. 1 and 2. A lens for correcting the field curvature is formed between the first electrode member 43 and the second electrode member 44, and between the third electrode member 45 and the fourth electrode member 46.

FIG. 20 illustrates a further constitution of the succeeding-stage offset structure shown in FIG. 1. In FIG. 20, the center axes of the outer electron beam passage holes in the third electrode member 45 are deviated from the center axes of the outer electron beam passage holes in the fourth electrode member 46. Here, the outer electron beam passage holes in the third electrode member 45 are in agreement with the center axes 9S of the outer sides, and the center axes of the outer electron beam passage holes in the fourth electrode member 46 are outwardly deviated relative to the center axes 9S of the outer sides.

That is, the substantial centers of the outer electron beam passage holes 463 in the fourth electrode member 46 on the side of the third electrode member 45 are deviated on a horizontal plane toward a direction opposite to the center electron beam passage holes 464 relative to the outer electron beams.

FIG. 21 illustrates another constitution of the preceding-stage offset structure shown in FIG. 2. In FIG. 21, the center axes of the outer electron beam passage holes in the first electrode member 43 are deviated from the center axes of the outer electron beam passage holes in the second electrode member 44. In this case, the center axes of the outer electron beam passage holes in the first electrode member 43 are in agreement with the center axes 9S of the outer sides, and the center axes of the outer electron beam passage holes in the second electrode member 44 are outwardly deviated relative to the center axes 9S of the outer sides.

Figure 22:
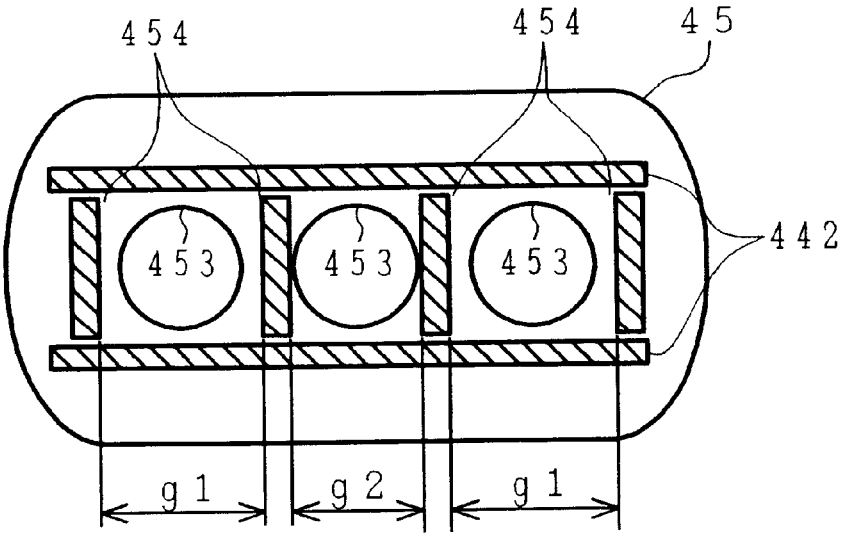
FIG. 22 is a sectional view illustrating a first structure of an electrostatic quadrupole lens according to the second embodiment of the present invention.

FIG. 22 is a diagram illustrating a first constitution of the electrostatic quadrupole lens according to the second embodiment and is a sectional view along the lines XXIIA—XXIIA and XXIIB—XXIIB in FIGS. 20 and 21.

Referring to FIG. 22, an electrostatic quadrupole lens is constituted between the second electrode member 44 and the third electrode member 45. That is, three electron beam passage holes 441 corresponding to the three electron beams are formed in the second electrode member 44 on the side of the third electrode member 45, and a pair of horizontal plate electrodes 442 extending toward the third electrode member are provided on the upper and lower sides of the electron beam passage holes in the vertical direction.

Furthermore, three electron beam passage holes 453 corresponding to the three electron beams are formed in the third electrode member 45 on the side of the second electrode member 44, and vertical plate electrodes 454 extending toward the second electrode member 44 are provided to sandwich the electron beam passage holes from both sides in the horizontal direction.

A relationship $g1>g2$ is maintained between a gap $g1$ of the vertical plate electrodes sandwiching the outer electron beams in the horizontal direction and a gap $g2$ of the vertical plate electrodes sandwiching the center electron beam in the horizontal direction.

The potential of the third electrode member 45 is higher than the potential of the fourth electrode member 46 at all times and, hence, the lens formed between the third electrode member 45 and the fourth electrode member 46 works to deflect the outer electron beams toward a direction opposite to the center electron beam. Therefore, the STC does not change like in the first embodiment.

The substantial centers of the outer electron beam passage holes in the fourth electrode member 46 on the side of the third electrode member 45 are deviated from the substantial centers of the outer electron beam passage holes in the third electrode member 45 on the side of the fourth electrode member 46.

In FIG. 20, the substantial centers of the outer electron beam passage holes in the fourth electrode member 46 on the side of the third electrode member 45 are deviated toward the direction opposite to the center electron beam passage hole relative to the center axes 9S of the outer sides on a horizontal plane. The diameter of the outer electron beam passage holes in the fourth electrode member 46 on the side of the third electrode member 45 in the horizontal direction is greater than the diameter of the center electron beam passage hole in the horizontal direction.

The fourth electrode member 46 has a potential lower than that of the third electrode member 45. Therefore, the intensity of the lens converging in the horizontal direction becomes weaker for the outer electron beams than for the center electron beam. Therefore, the lens for correcting the field curvature exhibits a weaker focusing force in the horizontal direction for the outer electron beams than for the center electron beam.

Accompanying an increase in the difference between the first focus voltage applied to the first type of focus electrode group and the second focus voltage applied to the second type of focus electrode group, therefore, the lens for correcting the curvature of image field formed between the third electrode member 45 and the fourth electrode member 46 works similarly to an electron lens having a ratio of the diameter of the lens for the outer electron beam in the vertical direction to the diameter thereof in the horizontal direction, which is larger than a ratio of the diameter of the lens for the center electron beam in the vertical direction to the diameter thereof in the horizontal direction.

In the electrostatic quadrupole lens constituted between the second electrode member 44 and the third electrode member 45, the first type of focus electrode group has a potential higher than that of the second type of focus electrode group at all times. Therefore, the potential of the third electrode member 45 becomes higher than the potential of the second electrode member 44 at all times. Therefore, the electrostatic quadrupole lens constituted between the second electrode member 44 and the third electrode member 45 works to focus the electron beam in the vertical direction and to diverge it in the horizontal direction. Besides, a relationship $g2<g1$ exists between a gap $g1$ of the vertical plate electrodes sandwiching the outer electron beam in the horizontal direction and a gap $g2$ of the vertical plate electrodes sandwiching the center electron beam in the horizontal direction. Therefore, the lens for the outer electron beam exhibits a diverging force in the horizontal direction which is weaker than the diverging force in the horizontal direction of the lens for the center electron beam.

Accompanying an increase in the difference between the first focus voltage applied to the first type of focus electrode group and the second focus voltage applied to the second type of focus electrode group, therefore, the electrostatic quadrupole lens formed between the second electrode member 44 and the third electrode member 45 works similarly to an electron lens having a ratio of the diameter of the lens for the outer electron beam in the vertical direction to the diameter thereof in the horizontal direction, which is smaller than a ratio of the diameter of the lens for the center electron beam in the vertical direction to the diameter thereof in the horizontal direction. That is, when the difference is great between the first focus voltage and the second focus voltage, the ratio of the diameters of the electron beams in the vertical direction to the diameters thereof in the horizontal direction (diameter in the vertical direction/diameter in the horizontal direction) is such that the center electron beam is smaller than the outer electron beams (center electron beam <outer electron beams).

Therefore, imbalance in the focusing force acting on the center electron beam and on the outer electron beams in the horizontal direction, due to the lens for correcting the field curvature formed between the third electrode member and the fourth electrode member, is canceled by the electrostatic quadrupole lens in order to prevent spot-like imbalance of the center electron beam and of the outer electron beams on the screen, making it possible to obtain an excellent resolution.

The constitution shown in FIG. 22 can be applied to the electron gun shown in FIG. 21 to obtain the same effects. Such electrodes including a pair of horizontal plate electrodes can be easily produced.

Figure 23:
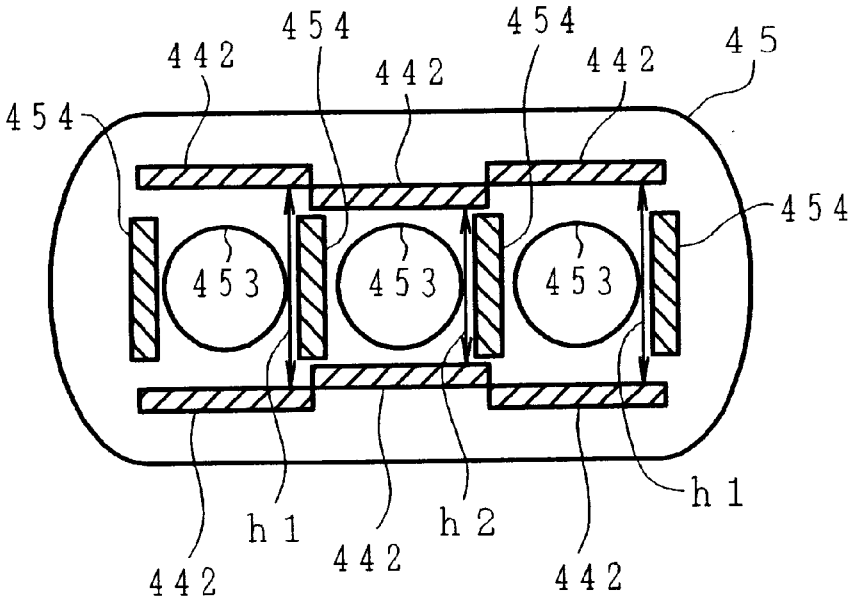
FIG. 23 is a sectional view illustrating a second structure of the electrostatic quadrupole lens according to the second embodiment of the present invention.

FIG. 23 is a diagram illustrating a second constitution of the electrostatic quadrupole lens according to the second embodiment and is a sectional view along the lines XXIIA—XXIIA and XXIIB—XIIB in FIGS. 20 and 21.

FIG. 23 illustrates the structure of the electrostatic quadrupole lens formed between the second electrode member 44 and the third electrode member 45. Three electron beam passage holes 441 corresponding to the three electron beams are formed in the second electrode member 44 on the side of the third electrode member 45, and horizontal plate electrodes 442 extending toward the third electrode member 45 are provided on the upper and lower sides of the electron beam passage holes in the vertical direction.

Furthermore, three electron beam passage holes 453 corresponding to the three electron beams are formed in the third electrode member 45 on the side of the second electrode member 44, and vertical plate electrodes 454 extending toward the second electrode member 44 are provided sandwiching the electron beams from both sides in the horizontal direction.

There further exists a relationship h1>h2 between a gap h1 of the horizontal plate electrodes sandwiching the outer electron beams in the vertical direction and a gap h2 of the horizontal plate electrodes sandwiching the center electron beam in the vertical direction.

Since there exists the relationship h1>h2 between the gap h1 of the horizontal plate electrodes sandwiching the outer electron beams in the vertical direction and the gap h2 of the horizontal plate electrodes sandwiching the center electron beam in the vertical direction, the intensity of the lens becomes weaker for the outer electron beams than for the center electron beam. Accordingly, a change in the STC decreases, spot-like imbalance of the electron beams is eliminated on the screen, and a favorable resolution is obtained on the whole screen.

The constitution shown in FIG. 23 can be applied to the electron gun shown in FIG. 21 to obtain similar effects. In the structure shown in FIG. 23, furthermore, the plate electrodes are remote from the electron beam passage holes. Therefore, the electron beam passage holes are little deformed by the provision of the plate electrodes. Besides, the structure can be easily produced.

Figure 24:
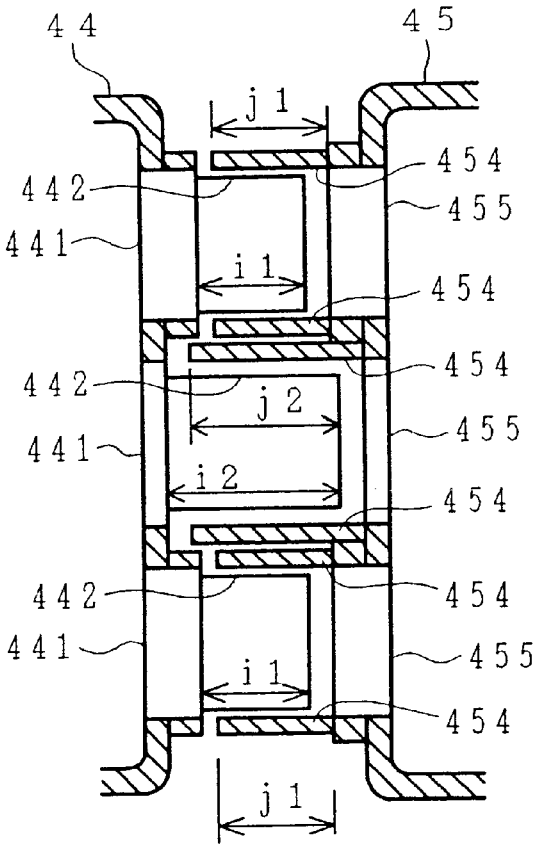
FIG. 24 is a sectional view illustrating a third structure of the electrostatic quadrupole lens according to the second embodiment of the present invention.

FIG. 24 is a diagram illustrating a third constitution of the electrostatic quadrupole lens according to the second embodiment and is a sectional view in the horizontal direction of FIGS. 20 and 21.

FIG. 24 illustrates the structure of the electrostatic quadrupole lens formed between the second electrode member 44 and the third electrode member 45. Three electron beam passage holes 441 corresponding to the three electron beams are formed in the second electrode member 44 on the side of the third electrode member 45, and horizontal plate electrodes 442 extending toward the third electrode member 45 are provided on the upper and lower sides of the electron beam passage holes in the vertical direction. Furthermore, three electron beam passage holes 455 corresponding to the three electron beams are formed in the third electrode member 45 on the side of the second electrode member 44, and vertical plate electrodes 454 extending toward the second electrode member 44 are formed to sandwich the electron beam passage holes from both sides in the horizontal direction.

When the length of the horizontal plate electrodes sandwiching the outer electron beams in the axial direction of the tube is denoted by i1. the length of the horizontal plate electrodes sandwiching the center electron beam in the axial direction of the tube is denoted by i2, the length of the vertical plate electrodes sandwiching the outer electron beams in the axial direction of the tube is denoted by j1, and the length of the vertical plate electrodes sandwiching the center electron beam in the axial direction of the tube is denoted by j2, then, the electrodes forming the electrostatic quadrupole lens have a relationship i1<i2 or j1<j2, or i1<i2 and j1<j2.

Since there exists a relationship i1<i2 or j1<j2, or i1<i2 and j1<j2 among the length i1 of the horizontal plate electrodes sandwiching the outer electron beams in the axial direction of the tube, the length i2 of the horizontal plate electrodes sandwiching the center electron beam in the axial direction of the tube, the length j1 of the vertical plate electrodes sandwiching the outer electron beams in the axial direction of the tube, and the length j2 of the vertical plate electrodes sandwiching the center electron beam in the axial direction of the tube, the lens produces a weaker intensity for the outer electron beams than for the center electron beam. This makes it possible to decrease a change in the STC, to eliminate spot-like imbalance of the electron beams on the screen, and to obtain a favorable resolution on the whole screen.

The constitution shown in FIG. 24 can be applied to the electron gun shown in FIG. 21 to obtain similar effects. In the structure shown in FIG. 24, furthermore, the plate electrodes are overlapped in small amounts making it possible to increase the breakdown voltage.

Figure 25:
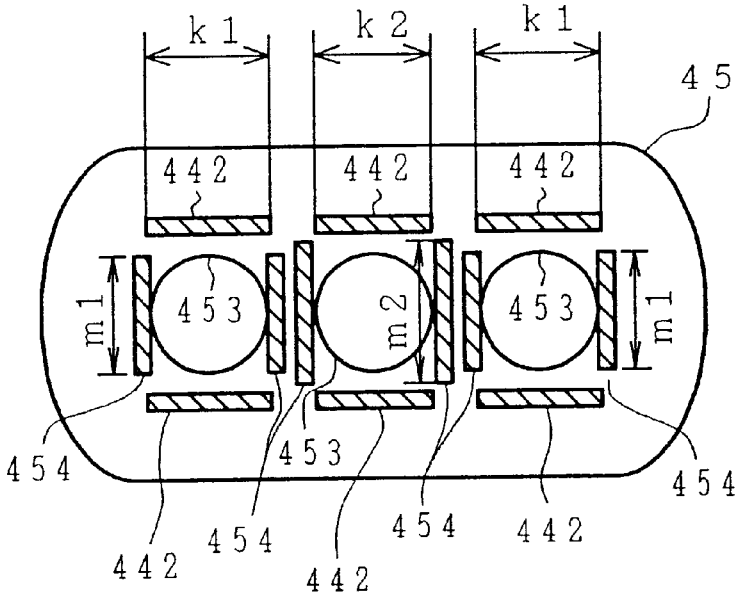
FIG. 25 is a sectional view illustrating a fourth structure of the electrostatic quadrupole lens according to the second embodiment of the present invention.

FIG. 25 is a diagram illustrating a fourth constitution of the electrostatic quadrupole lens according to the second embodiment and is a sectional view along the lines XXIIA—XXIIA and XXIIB—XXIIB in FIGS. 20 and 21.

As shown in FIGS. 20 and 21, in the structure of the electrostatic quadrupole lens of FIG. 25 formed between the second electrode member 44 and the third electrode member 45, the three electron beam passage holes 441 corresponding to the three electron beams are formed in the second electrode member 44 on the side of the third electrode member 45, and horizontal plate electrodes 442 extending toward the third electrode member are provided on the upper and lower sides of the electron beam passage holes in the vertical direction.

Furthermore, three electron beam passage holes 453 corresponding to the three electron beams are formed in the third electrode member on the side of the second electrode member 44, and vertical plate electrodes 454 extending toward the second electrode member 44 are provided to sandwich the electron beam passage holes from both sides in the horizontal direction.

When the width of the horizontal plate electrodes sandwiching the outer electron beams in the horizontal direction is denoted by k1, the width of the horizontal plate electrodes sandwiching the center electron beam in the horizontal direction by k2, the width of the vertical plate electrodes sandwiching the outer electron beams in the vertical direction by m1, and the width of the vertical plate electrodes sandwiching the center electron beam in the vertical direction by m2, the electrodes forming the electrostatic quadrupole lens have a relationship k1<k2 or m1<m2, or k1<k2 and m1<m2.

Since there exists a relationship k1<k2 or m1<m2, or k1<k2 and m1<m2 among the width kl of the horizontal plate electrodes sandwiching the outer electron beams in the horizontal direction, the width k2 of the horizontal plate electrodes sandwiching the center electron beam in the horizontal direction, the width m1 of the vertical plate electrodes sandwiching the outer electron beams in the vertical direction, and the width m2 of the vertical plate electrodes sandwiching the center electron beam in the vertical direction, the lens produces a weaker intensity for the outer electron beams than for the center electron beam. This makes it possible to decrease a change in the STC, to eliminate spot-like imbalance of the electron beams on the screen, and to obtain a favorable resolution on the whole screen.

The constitution shown in FIG. 25 can be applied to the electron gun shown in FIG. 21 to obtain similar effects. In the structure shown in FIG. 25, furthermore, the size of the vertical plate electrodes can be decreased.

Figure 26:
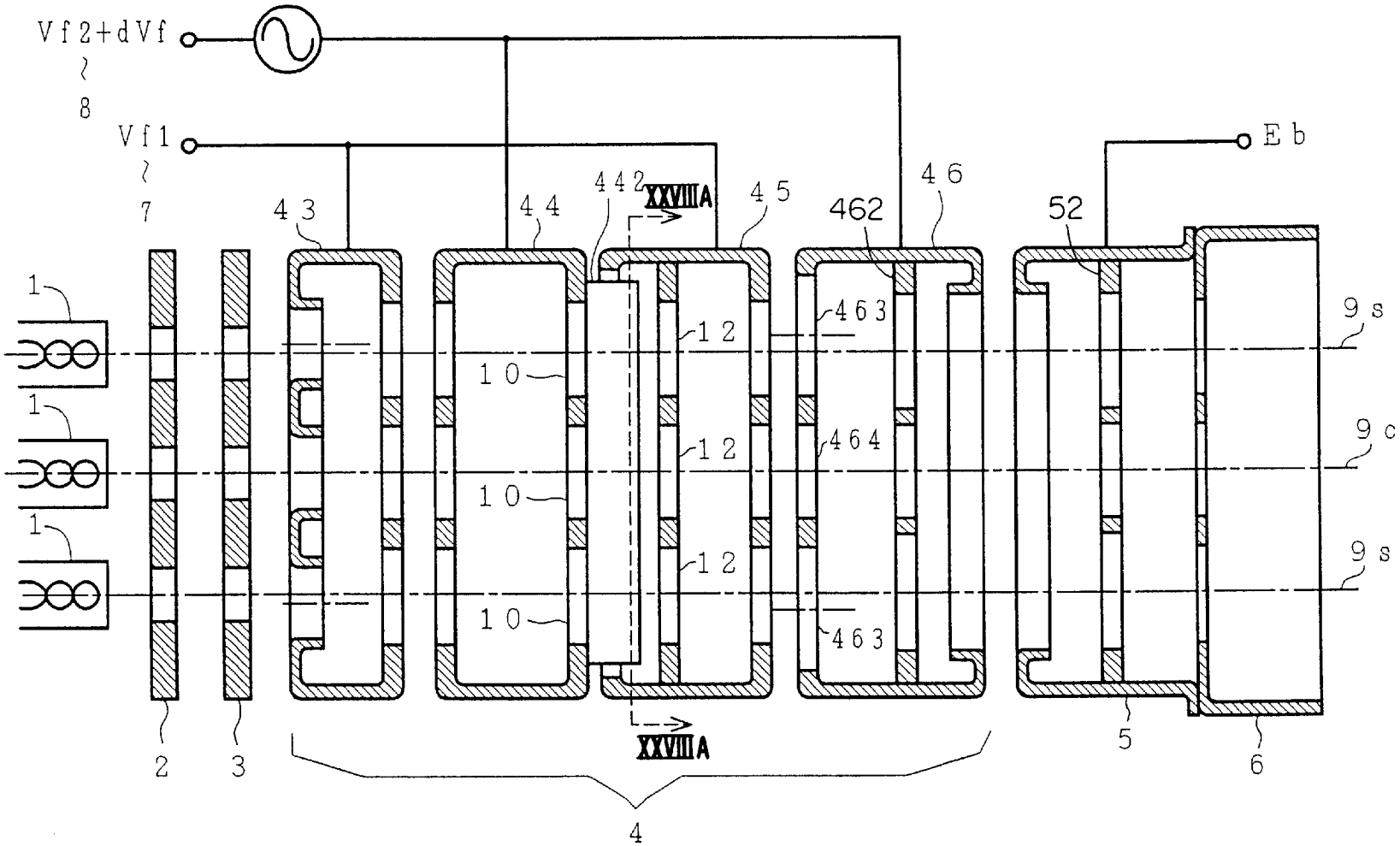
FIG. 26 is a sectional view of the main lens in the electron gun having a further structure according to the second embodiment of the present invention.
Figure 27:
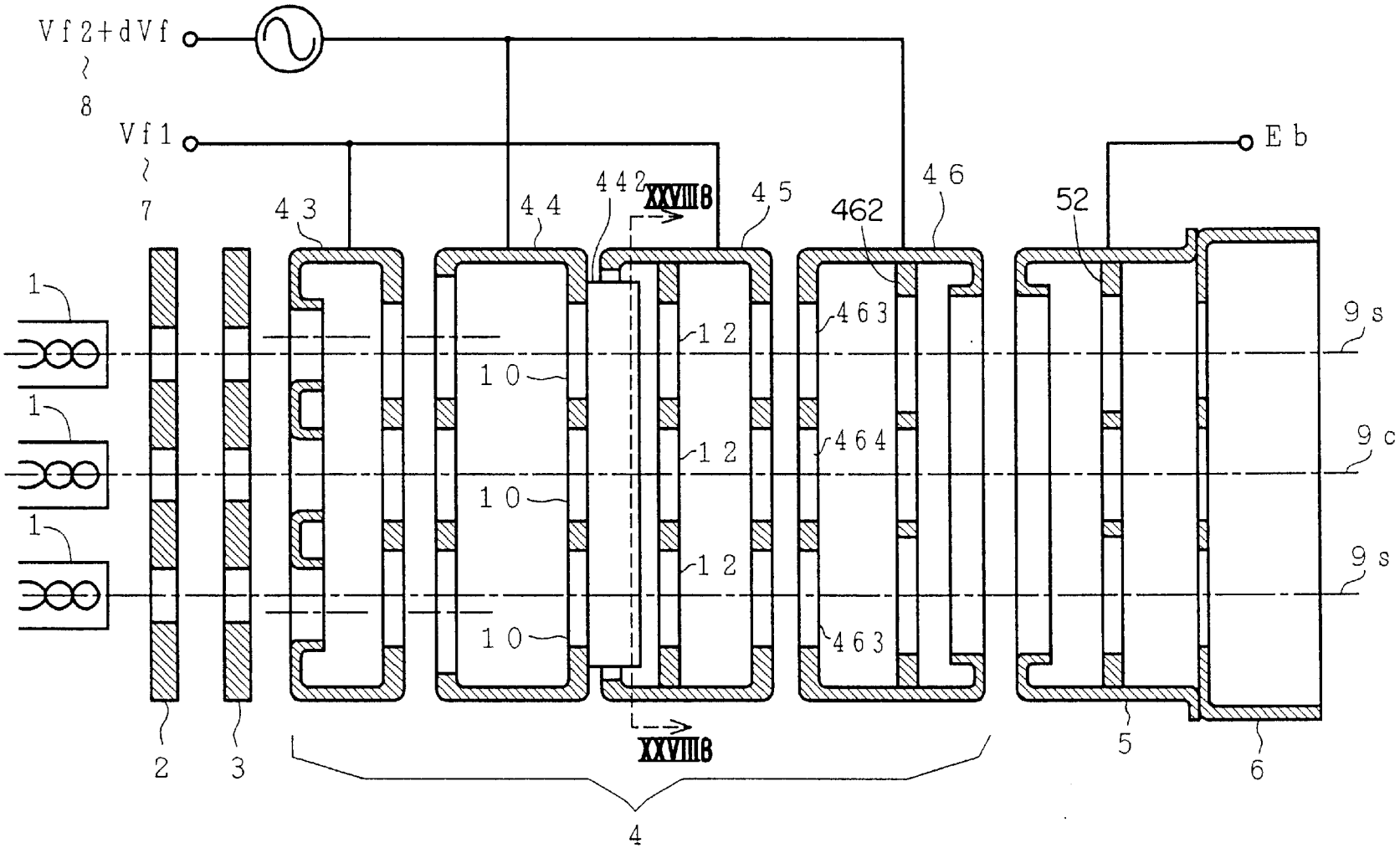
FIG. 27 is a sectional view of the main lens in the electron gun having a still further structure according to the second embodiment of the present invention.
Figure 28:
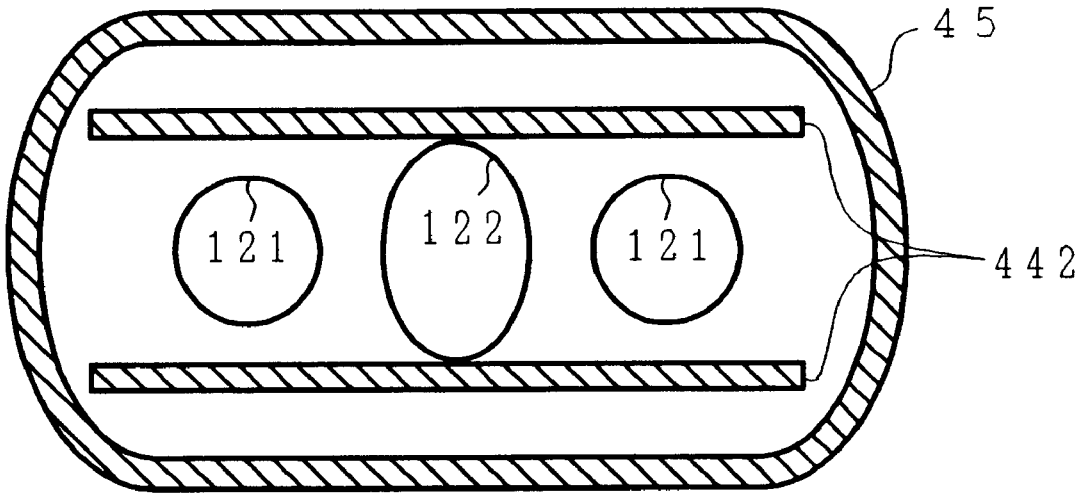
FIG. 28 is a sectional view illustrating a fifth constitution of the electrostatic quadrupole lens according to the second embodiment.

FIGS. 26 and 27 are sectional views illustrating a major portion of another constitution of the electron gun according to the second embodiment. FIG. 28 is a sectional view along the lines XXVIIIA—XXVIIIA and XXVIIIB—XXVIIIB of FIGS. 26 and 27 to explain the constitution of the electrostatic quadrupole lens and illustrates a fifth constitution of the second embodiment.

The electron gun shown in FIGS. 26 and 27 works to correct the convergence between the accelerating electrode 3 and the focus electrode 4, and in this electron gun, the center axes of the outer sides of the accelerating electrode 3 are deviated from the center axes of the outer sides of the first electrode member 43. The center axes of the outer sides of the first electrode member 43 are deviated toward the direction opposite to the center axis at the center in the in-line direction, in order to correct the trajectories of the outer electron beams toward a direction to approach the center electron beam. In the electrodes forming the main lens, furthermore, a distance between the center axis 9C of the center beam passage hole and the center axis of the outer beam passage hole among the three electron beam passage holes formed in the electrode plate 462 is set to be equal to a distance between the center axis 9C of the center beam passage hole and the center axis of the outer beam passage hole among the three electron beam passage holes formed in the electrode plate 52.

The main lens exhibits the STC action even when the center axes of the outer holes of the two electrodes constituting the main lens are concentric, as shown in FIGS. 26 and 27. Therefore, when the focus voltage applied to the focus electrode, which is opposed to the anode 5 and which forms the main lens, changes in synchronism with a change in the deflection angle for scanning the electron beams on the screen, the intensity of the main lens formed by the anode 5 and by the fourth focus electrode 46 undergoes a change, whereby the STC action of the main lens changes.

In FIG. 26, the center axes of the outer electron beam passage holes of the third electrode member 45 are deviated from the center axes of the outer electron beam passage holes of the fourth electrode member 46. In this case, the outer electron beam passage holes of the third electrode member 45 are in agreement with the center axes 9S of the outer sides, and the center axes of the outer electron beam passage holes of the fourth electrode member 46 are outwardly deviated relative to the center axes 9S of the outer sides.

That is, the substantial centers of the outer electron beam passage holes 463 in the fourth electrode member 46 on the side of the third electrode member 45 are deviated away from the center electron beam passage hole 464 relative to the outer electron beams on a horizontal plane.

In FIG. 27, the outer electron beam passage holes in the first electrode member 43 opposite to the second electrode member 44 are in agreement with the center axes 9S of the outer sides, and the center axes of the outer electron beam passage holes in the second electrode member 44 opposite to the first electrode member 43 are outwardly deviated relative to the center axes 9S of the outer sides.

In this electron gun, the focus electrode group 4 is constituted by the first electrode member 43, second electrode member 44, third electrode member 45 and fourth electrode member 46, to fabricate the electrostatic quadrupole lens, which is different from that of the aforementioned embodiment.

In FIGS. 26, 27 and 28, three electron beam passage holes 10 corresponding to the three electron beams are formed in the second electrode member 44 on the side of the third electrode member 45, and horizontal electrode pieces 442 extending toward the third electrode member 45 are provided on the upper and lower sides of the electron beam passage holes in the vertical direction. Furthermore, three electron beam passage holes 12 (121, 122, 121) corresponding to the three electron beams are formed in the third electrode member 45 on the side of the second electrode member 44. A ratio of the diameter of the outer electron beam passage holes 121 in the third electrode member 45 on the side of the second electrode member 44 in the vertical direction to the diameter thereof in the horizontal direction is set to be smaller than a ratio of the diameter of the center electron beam passage hole 122 in the vertical direction to the diameter thereof in the horizontal direction.

Since the ratio of the diameter of the outer electron beam passage holes in the third electrode member 45 on the side of the second electrode member 44 in the vertical direction to the diameter thereof in the horizontal direction is smaller than the ratio of the diameter of the center electron beam passage hole in the vertical direction to the diameter thereof in the horizontal direction, the lens produces a weaker intensity for the outer electron beams than for the center electron beam. This makes it possible to decrease a change in the STC, to eliminate spot-like imbalance of the electron beams on the screen, and to obtain a favorable resolution on the whole screen.

Figure 29:
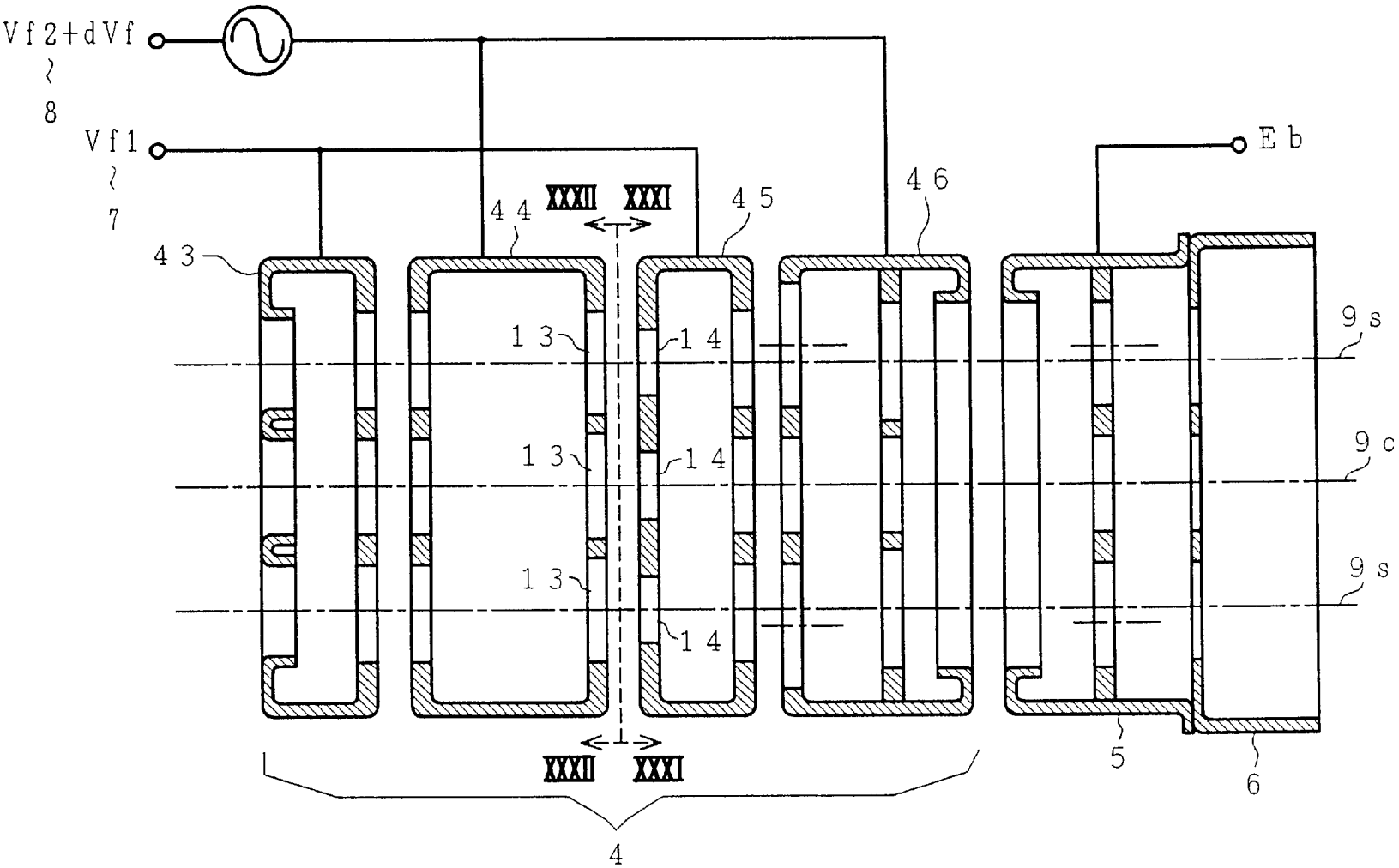
FIG. 29 is a sectional view of the main lens in the electron gun having a yet further structure according to the second embodiment of the present invention.
Figure 30:
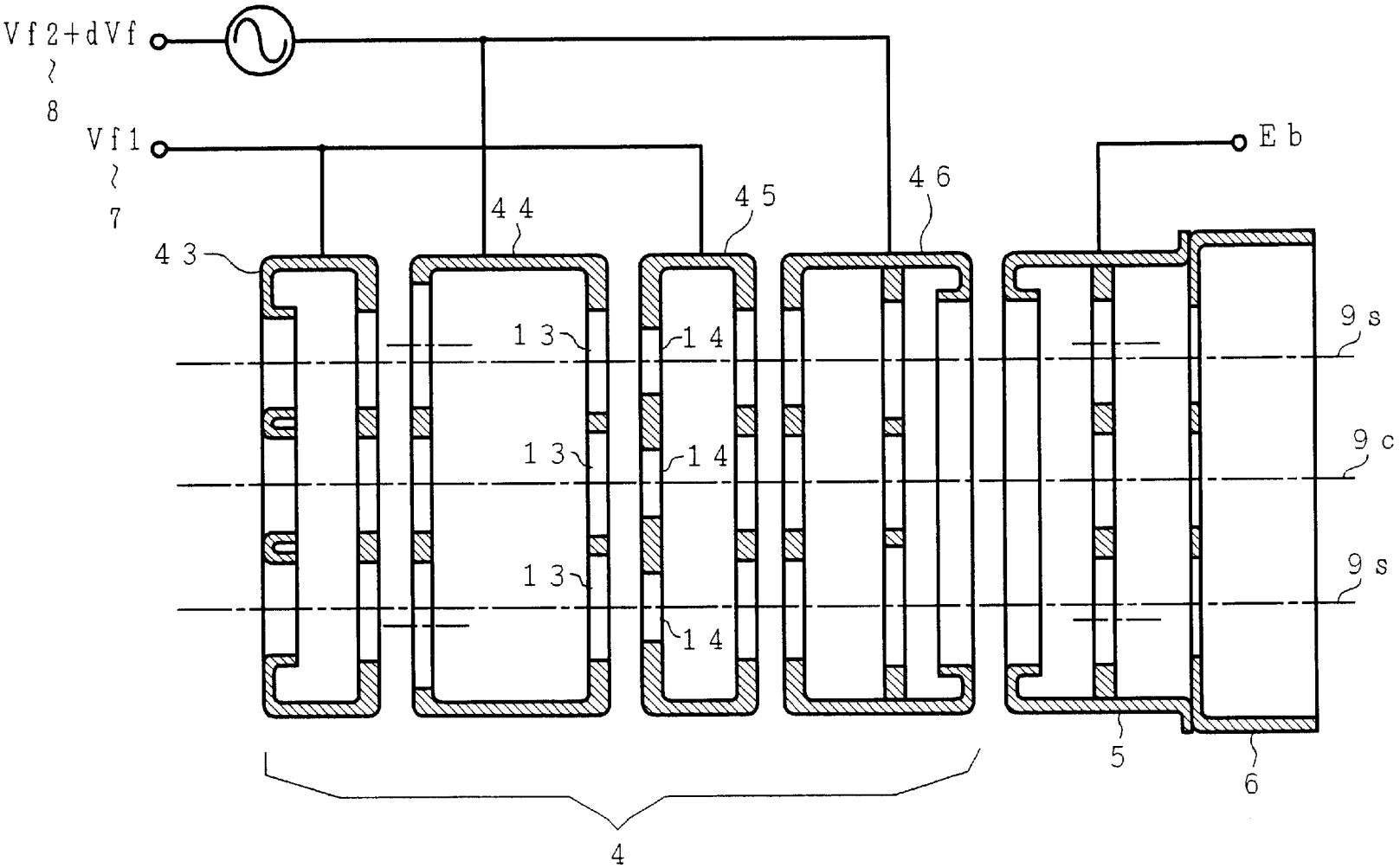
FIG. 30 is a sectional view of the main lens in the electron gun having a further structure according to the second embodiment of the present invention.

FIGS. 29 and 30 are sectional views illustrating a major portion of the main lens for explaining another constitution of the electron gun according to the second embodiment.

In FIG. 29, the center axes of the outer electron beam passage holes in the third electrode member 45 are deviated from the center axes of the outer electron beam passage holes in the fourth electrode member 46. In this case, the outer electron beam passage holes in the third electrode member 45 are in agreement with the center axes 9S of the outer sides, and the center axes of the outer electron beam passage holes in the fourth electrode member 46 are outwardly deviated relative to the center axes 9S of the outer sides.

That is, the substantial centers of the outer electron beam passage holes in the fourth electrode member 46 on the side of the third electrode member 45 are deviated toward the direction opposite to the center electron beam passage hole relative to the outer electron beams on a horizontal plane.

In FIG. 30, the center axes of the outer electron beam passage holes in the first electrode member 43 are deviated from the center axes of the outer electron beam passage holes in the second electrode member 44. In this case, the outer electron beam passage holes in the first electrode member 43 are in agreement with the center axes 9S of the outer sides, and the center axes of the outer electron beam passage holes in the second electrode member 44 are outwardly deviated relative to the center axes 9S of the outer sides.

That is, the substantial centers of the outer electron beam passage holes in the second electrode member 44 on the side of the first electrode member 43 are deviated toward the direction opposite to the center electron beam passage hole relative to the outer electron beams on a horizontal plane.

FIGS. 29 and 30 are sectional views of the electron gun forming an electrostatic quadrupole lens in which vertically elongated electron beam passage holes are formed in one of the opposing electrodes and laterally elongated electron beam passage holes are formed in the other electrode. Those portions which are the same as those of FIGS. 10 and 11 are denoted by the same reference numerals.

Figure 31:
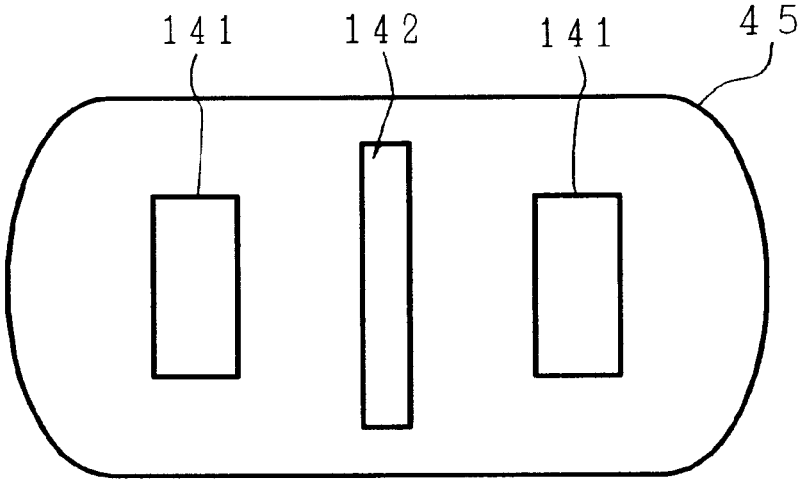
FIG. 31 is a sectional view illustrating a sixth constitution of the electrostatic quadrupole lens according to the second embodiment.

FIG. 31 is a sectional view along the line XXXI—XXXI in FIGS. 29 and 30.

Three electron beam passage holes 13 corresponding to the three electron beams are formed in the second electrode member 44 on the side of the third electrode member 45, and three electron beam passage holes 14 corresponding to the three electron beams are formed in the third electrode member 45 on the side of the second electrode member 44.

A ratio of the diameter of the outer electron beam passage holes 141 in the third electrode member 45 on the side of the second electrode member 44 in the vertical direction to the diameter thereof in the horizontal direction is set to be smaller than a ratio of the diameter of the center electron beam passage hole 142 in the vertical direction to the diameter thereof in the horizontal direction.

Since the ratio of the diameter of the outer electron beam passage holes in the third electrode member 45 on the side of the second electrode member 44 in the vertical direction to the diameter thereof in the horizontal direction is smaller than the ratio of the diameter of the center electron beam passage hole in the vertical direction to the diameter thereof in the horizontal direction, the lens produces a weaker intensity for the outer electron beams than for the center electron beam. This makes it possible to decrease a change in the STC, to eliminate spot-like imbalance of the electron beams on the screen, and to obtain a favorable resolution on the whole screen.

Figure 32:
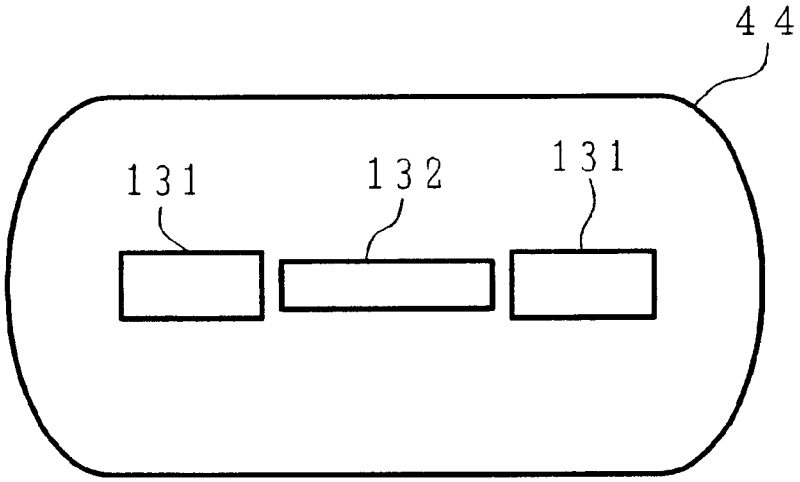
FIG. 32 is a sectional view illustrating the sixth constitution of the electrostatic quadrupole lens according to the second embodiment.

FIG. 32 is a sectional view along the line XXXII—XXXII in FIGS. 29 and 30, and shows electron beam passage holes in the second electrode member 44 that constitutes the electrostatic quadrupole lens.

As shown in FIG. 29 and FIG. 30, three electron beam passage holes 13 corresponding to the three electron beams are formed in the second electrode member 44 on the side of the third electrode member 45, and three electron beam passage holes 14 corresponding to the three electron beams are formed in the third electrode member 45 on the side of the second electrode member 44.

A ratio of the diameter of the outer electron beam passage holes 131 in the second electrode member 44 on the side of the third electrode member 45 in the vertical direction to the diameter thereof in the horizontal direction is set to be larger than a ratio of the diameter of the center electron beam passage hole 132 in the vertical direction to the diameter thereof in the horizontal direction.

Since the ratio of the diameter in the horizontal direction of the outer electron beam passage holes in the second electrode member 44 on the side of the third electrode member 45 in the vertical direction to the diameter thereof in the horizontal direction is smaller than the ratio of the diameter of the center electron beam passage hole in the vertical direction to the diameter thereof in the horizontal direction, the lens produces a weaker intensity for the outer electron beams than for the center electron beam. This makes it possible to decrease a change in the STC, to eliminate spot-like imbalance of the electron beams on the screen, and to obtain a favorable resolution on the whole screen.

In the above-mentioned embodiment, the electron beam passage holes in the electrodes forming the lens for correcting the field curvature have shorter axes in the vertical direction and have longer axes in the horizontal direction. The invention, however, is in no way limited thereto, but can also be adapted to an electron gun in which the electron beam passage holes in the electrodes forming the lens for correcting the field curvature have longer axes in the vertical direction and shorter axes in the horizontal direction.

Moreover, the electrostatic quadrupole lens is formed with the electron beam passage holes and the electron beam passage holes abutted together. Therefore, the electrodes can be easily formed.

FIGS. 33*a* to 35*b* illustrate a seventh constitution according to the second embodiment, in which imbalanced focusing by the lens for correcting the field curvature that works to correct a change in the STC is corrected by another lens for correcting the curvature in the image field.

FIGS. 33*a* and 33*b*, FIGS. 34*a* and 34*b*, and FIGS. 35*a* and 35*b*, are diagrams of opposing surfaces of the lens for correcting the field curvature without the action for correcting a change in the STC, and show the electron beam passage holes.

Figure 33A:
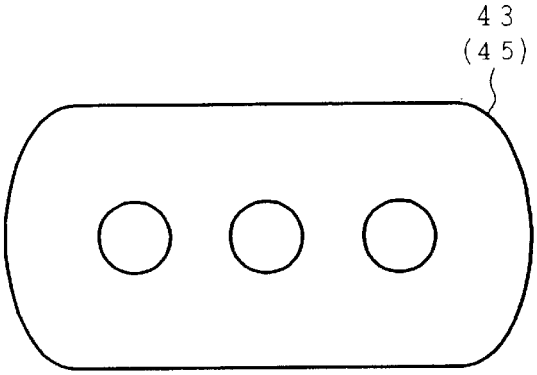
FIGS. 33*a* and 33*b* are sectional views illustrating a seventh constitution of the lens for correcting the field curvature according to the second embodiment.
Figure 33B:
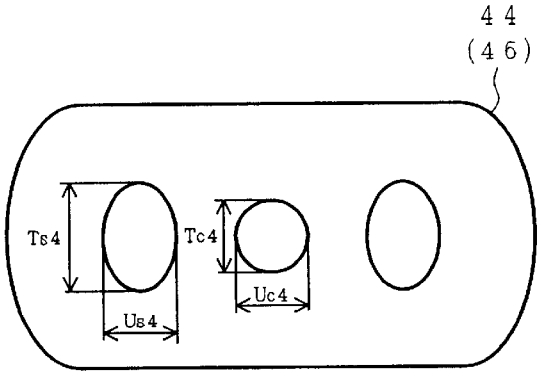
Figure 34A:
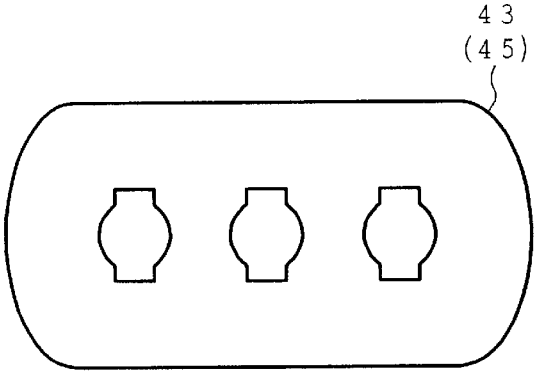
FIGS. 34*a* and 34*b* are sectional views illustrating the seventh constitution of the lens for correcting the field curvature according to the second embodiment.
Figure 34B:
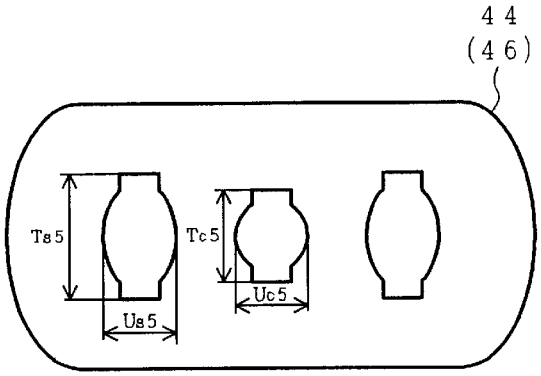
Figure 35A:
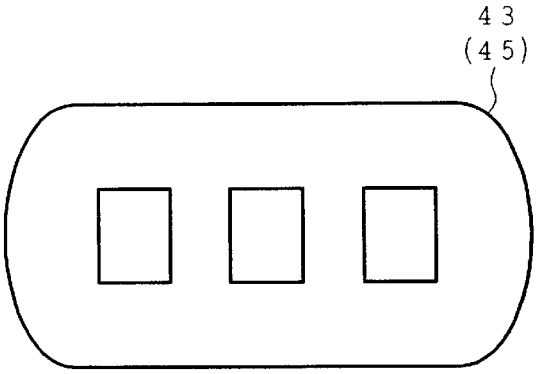
FIGS. 35*a* and 35*b* are sectional views illustrating the seventh constitution of the lens for correcting the field curvature according to the second embodiment.
Figure 35B:
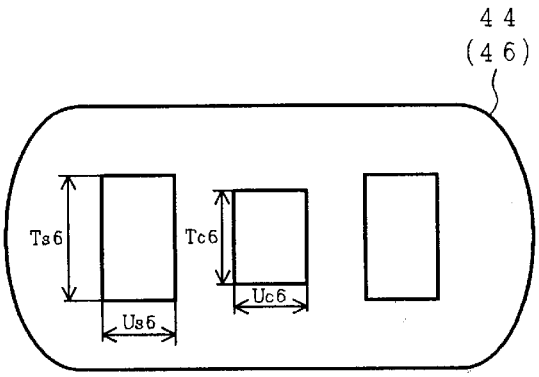

FIGS. 33*a*, 34*a* and 35*a* show electron beam passage holes formed in the first electrode member 43 on the side of the second electrode member in FIG. 20. FIGS. 33*b*, 34*b* and 35*b* show electron beam passage holes formed in the second electrode member 44 on the side of the first electrode member in FIG. 20. The electron beam passage holes in the first electrode member 43 and the electron beam passage holes in the second electrode member 44 are in agreement with the center axes 9 (9C, 9S). The electron beam passage holes in the second electrode member 44 have a ratio (diameter in the vertical direction/diameter in the horizontal direction) of the diameter of the outer electron beam passage holes in the vertical direction to the diameter thereof in the horizontal direction, which is larger than a ratio (diameter in the vertical direction/diameter in the horizontal direction) of the center electron beam passage hole in the vertical direction to the diameter thereof in the horizontal direction (ratio of the outer electron beam passage holes>ratio of the center electron beam passage hole).

Besides, the electron beam passage holes in the first electrode member 42 on the side of the second electrode member are all of the same shape which is the same as the shape of the center beam passage hole in the second electrode member 44 on the side of the first electrode member. Moreover, the electron beam passage holes in the second electrode member 44 on the side of the first electrode member and the electron beam passage holes in the first electrode member 43 on the side of the second electrode member are all of the same diameter in the horizontal direction. Therefore, the lens for the outer electron beams controls the focusing force in the vertical direction only.

The lens produces a weaker focusing action for the outer electron beams in the vertical direction than for the center electron beam in the vertical direction.

That is, when the difference is great between the first focus voltage and the second focus voltage, the ratio of the diameters of the electron beams (diameter in the vertical direction/diameter in the horizontal direction) becomes such that the center electron beam>outer electron beams, whereby the dynamic voltage is lowered, a change in the STC decreases, spot-like imbalance of the electron beams is eliminated on the screen, and a favorable resolution is obtained on the screen.

As for the electron beam passage holes shown in FIG. 33*b,* the outer electron beam passage holes are elongated in the vertical direction. The outer electron beam passage holes have a vertical diameter Ts4 which is longer than a vertical diameter Tc4 of the center electron beam passage hole, and have a horizontal diameter Us4 which is equal to a horizontal diameter Uc4 of the center electron beam passage hole.

As for the electron beam passage holes shown in FIG. 34*b,* the outer electron beam passage holes have a vertical diameter Ts5 which is longer than a vertical diameter Tc5 of the center electron beam passage hole, and have sides without curvature at the upper and lower portions of the electron beam passage holes. Upon forming portions without curvature, the length of the sides can be adjusted by changing the curvature of the arcuate portion, thereby controlling the focusing force and, hence, easily controlling the focusing force of the electron lens. The outer electron beam passage holes have a horizontal diameter Us5 which is equal to the horizontal diameter Uc5 of the center electron beam passage hole.

As for the electron beam passage holes shown in FIG. 35*b,* the outer electron beam passage holes are of a rectangular shape in the vertical direction. The outer electron beam passage holes have a vertical diameter Ts6 which is longer than a vertical diameter Tc6 of the center electron beam passage hole, and have a horizontal diameter Us6 which is equal to a horizontal diameter Uc6 of the center electron beam passage hole.

Upon applying the constitutions shown in FIGS. 33*b,* 34*b* and 35*b* to the third electrode member 45 of FIG. 21 and applying the constitutions shown in FIGS. 14*a,* 15*a* and 16*a* to the fourth electrode member 46 of FIG. 21, it is possible to decrease the dynamic voltage, to decrease a change in the STC, to eliminate spot-like imbalance of the electron beams on the screen, and to obtain a favorable resolution over the whole screen.

The lens for correcting the field curvature exhibits the action for focusing the electron beams in both the horizontal direction and the vertical direction. Therefore, the adjustment may be effected in either the horizontal direction or the vertical direction, enabling the lens to be easily produced.

Next, described below are the shapes of the electrodes for forming the lens for correcting the field curvature according to the second embodiment of the present invention. In particular, described below is the lens for correcting the field curvature that has an action for correcting a change in the STC of the main lens in the electron gun of the succeeding-stage offset structure (FIGS. 20, 26 and 29).

Figure 36A:
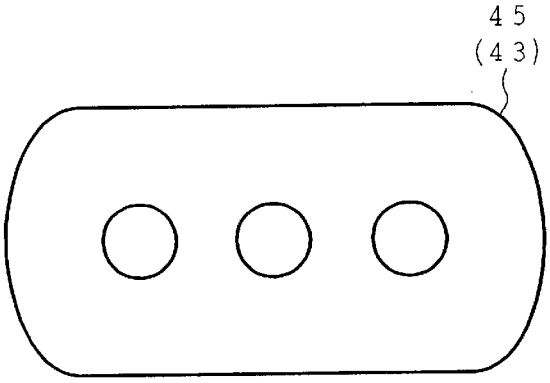
FIGS. 36*a* and 36*b* are sectional views illustrating a constitution of the lens for correcting the field curvature according to the second embodiment.
Figure 36B:
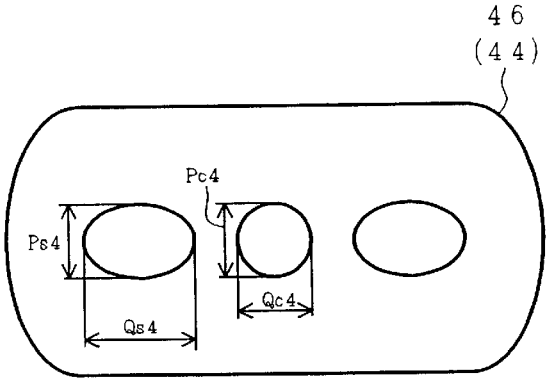

FIG. 36*a* shows the electron beam passage holes in the third electrode member 45 on the side of the fourth electrode member 46, and FIG. 36*b* shows the electron beam passage holes in the fourth electrode member 46 on the side of the third electrode member 45 according to the second embodiment. In this embodiment, as shown in FIG. 36*a,* the electron beam passage holes in the third electrode member 45 on the side of the fourth electrode member 46 are of the same circular shape as the center electron beam passage hole 464 in the fourth electrode member 46 on the side of the third electrode member 45. The outer electron beam passage holes 463 in the fourth electrode member 46 on the side of the third electrode member 45 have a horizontal diameter Qs4 which is longer than a horizontal diameter Qc4 of the center electron beam passage hole 464, and have a vertical diameter Ps4 which is equal to a vertical diameter Pc4 of the center electron beam passage hole 464.

In an electron gun in which the third electrode member 45 and the fourth electrode member 46 are opposed to each other, and the center of the center electron beam passage hole is brought into agreement with the center axis 9C, the centers of the outer electrodes of the fourth electrode member 46 are outwardly deviated from the center axes 95 of the outer sides.

Figure 37A:
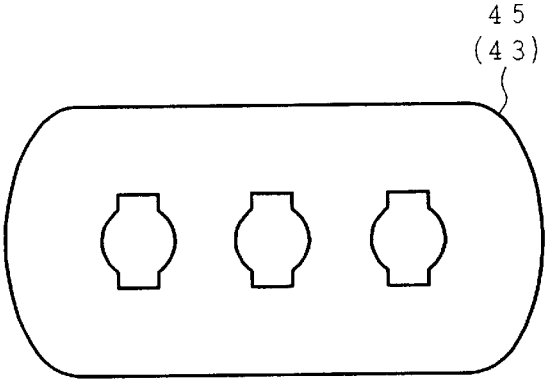
FIGS. 37*a* and 37*b* are sectional views illustrating the constitution of the lens for correcting the field curvature according to the second embodiment.
Figure 37B:
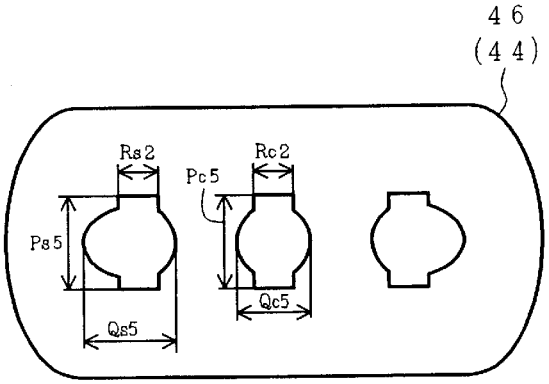

FIGS. 37*a* and 37*b* illustrate a further constitution of the electron beam passage holes in the third electrode member 45 on the side of the fourth electrode member 46, and of the electron beam passage holes in the fourth electrode member 46 on the side of the third electrode member 45 according to the second embodiment. The electron beam passage holes in the third electrode member 45 on the side of the fourth electrode member 46 shown in FIG. 37*a* are of the same shape as the center electron beam passage hole 464 in the fourth electrode member 46. The outer electron beam passage holes 463 shown in FIG. 37*b* have a horizontal diameter Qs5 which is longer than a horizontal diameter Qc5 of the center electron beam passage hole 464. Referring to FIG. 37*b,* the outer electron beam passage holes 463 have a vertical diameter Ps5 which is equal to a vertical diameter Pc5 of the center electron beam passage hole 464, and rectangular portions of the outer electron beam passage holes 463 have a width Rs2, which is equal to a width Rc2 of the rectangular portion of the center electron beam passage hole 464.

In an electron gun in which the third electrode member 45 and the fourth electrode member 46 are opposed to each other, and the center of the center electron beam passage hole is brought into agreement with the center axis 9C, the centers of the outer electrodes of the fourth electrode member 46 are outwardly deviated from the center axes 95 of the outer sides.

Figure 38A:
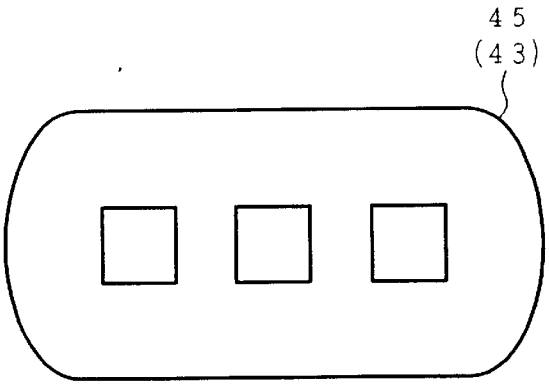
FIGS. 38*a* and 38*b* are sectional views illustrating the constitution of the lens for correcting the field curvature according to the second embodiment.
Figure 38B:
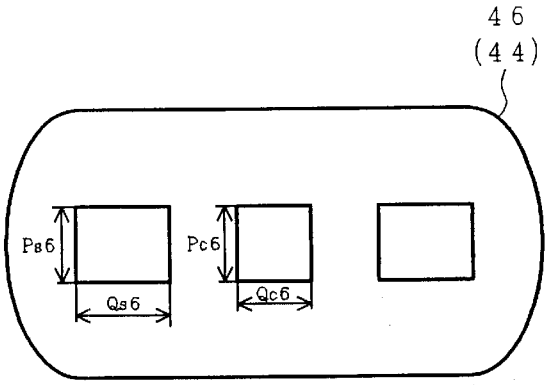

FIGS. 38*a* and 38*b* illustrate a still further constitution of the electron beam passage holes in the third electrode member 45 on the side of the fourth electrode member 46, and of the electron beam passage holes in the fourth electrode member 46 on the side of the third electrode member 45 according to the second embodiment. The electron beam passage holes in the third electrode member 45 on the side of the fourth electrode member 46 shown in FIG. 38*a* are of the same rectangular shape as the center electron beam passage hole 464 in the fourth electrode member 46. The outer electron beam passage holes 463 shown in FIG. 38*b* have a horizontal diameter Qs6 which is longer than a horizontal diameter Qc6 of the center electron beam passage hole 464. Referring to FIG. 38*b,* the outer electron beam passage holes 463 have a vertical diameter Ps6 which is equal to a vertical diameter Pc6 of the center electron beam passage hole 464.

In an electron gun in which the third electrode member 45 and the fourth electrode member 46 are opposed to each other, and the center of the center electron beam passage hole is brought into agreement with the center axis 9C, the centers of the outer electrodes of the fourth electrode member 46 are outwardly deviated from the center axes 95 of the outer sides.

In the electrodes forming the lens for correcting the field curvature shown in FIGS. 36 to 38, the diameters of the electron beam passage holes are set to be constant in the vertical direction, and the diameter of the outer electron beam passage holes is changed in the horizontal direction to deviate the center axes of the outer electron beam passage holes. In the lens for correcting the field curvature, therefore, the three electron lenses produce nearly the same focusing force in the vertical direction and, hence, the convergence action only may be taken into consideration.

According to the present invention as described above, there is provided a color cathode-ray tube which lowers the dynamic voltage, decreases a change in the STC, eliminates spot-like imbalance of the electron beams, and which is manufactured at a decreased cost, while still offering a good resolution over the whole screen.

What is claimed is:

1. A color cathode-ray tube comprising at least a panel portion having a phosphor screen on an inner surface thereof, a neck portion, a funnel portion connecting said panel portion and said neck portion, an in-line type electron gun housed in said neck portion, and a deflection yoke for scanning electron beams on the phosphor screen; wherein said electron gun has a cathode, a control electrode, an accelerating electrode and a main lens section disposed in the recited order in a direction toward said phosphor screen:

said main lens section comprising an anode to which an anode voltage is applied, and a focus electrode, said focus electrode having a first type of focus electrode group to which a first focus voltage is applied, and a second type of focus electrode group to which a second focus voltage is applied;

said second focus voltage is obtained by superposing a voltage, that changes depending upon the deflecting amount of the electron beams, on a predetermined voltage;

between the first type of focus electrode group and the second type of focus electrode group are formed at least two electron lenses including a lens for correcting the field curvature for focusing the electron beams in both the horizontal direction and the vertical direction, and an electrostatic quadrupole lens for focusing said electron beams in either the horizontal direction or the vertical direction and for diverging the electron beams in the other of said directions;

three electron beam passage holes are formed in the electrodes that form said lens for correcting the field curvature, and the centers of the outer electron beam passage holes in the first type of focus electrode group are deviated relative to the centers of the outer electron beam passage holes in the second type of focus electrode group in the horizontal direction; and said electrostatic quadrupole lens exhibits different intensities for the outer electron beams relative to the center electron beam.

2. A color cathode-ray tube according to claim 1, wherein the centers of said outer electron beam passage holes in the first type of focus electrode forming the lens for correcting the field curvature are deviated toward the center electron beam relative to the centers of the outer electron beam passage holes in the second type of focus electrode; and said electrostatic quadrupole lens exhibits a stronger intensity for the outer electron beams than for the center electron beam.

3. A color cathode-ray tube according to claim 2, wherein the anode forming a portion of said main lens section in said electron gun and an electrode belonging to said second type focus electrode group which neighbors said anode, have electron beam passage holes through which the three electron beams arranged in said horizontal direction pass, and the centers of the outer electron beam passage holes in said anode are deviated on a horizontal plane relative to the centers of said outer electron beam passage holes in the electrode belonging to said second type of focus electrode group.

4. A color cathode-ray tube according to claim 2, wherein said accelerating electrode neighbors said first type of focus electrode, said accelerating electrode and said first type of focus electrode, respectively, have electron beam passage holes through which the three electron beams arranged in the horizontal direction pass, and the centers of the outer electron beam passage holes in said first type of focus electrode are deviated on a horizontal plane relative to the centers of the outer electron beam passage holes in said accelerating electrode.

5. A color cathode-ray tube according to claim 2, wherein said electrostatic quadrupole lens for the outer electron beams produces a stronger diverging action in the horizontal direction than said electrostatic quadruple lens for the center electron beam.

6. A color cathode-ray tube according to claim 1, wherein the centers of the outer electron beam passage holes in the second type of focus electrode forming the lens for correcting the field curvature are deviated toward a direction opposite to the center electron beam relative to the centers of the outer electron beam passage holes in the first type of focus electrode; and said electrostatic quadrupole lens exhibits a weaker action for the outer electron beams than for the center electron beam.

7. A color cathode-ray tube according to claim 6, wherein said anode forming a portion of the main lens section of said electron gun and the second type of focus electrode neighboring said anode, respectively, have electron beam passage holes through which the three electron beams arranged in the horizontal direction pass, and the centers of the outer electron beam passage holes in said anode are deviated on a horizontal plane relative to the centers of the outer electron beam passage holes in said second type of focus electrode.

8. A color cathode-ray tube according to claim 6, wherein said accelerating electrode neighbors said first type of focus electrode, said accelerating electrode and said first type of focus electrode, respectively, have electron beam passage holes through which the three electron beams arranged in the horizontal direction pass, and the centers of the outer electron beam passage holes in said first type of focus electrode are deviated on a horizontal plane relative to the centers of said outer electron beam passage holes in said accelerating electrode.

9. A color cathode-ray tube according to claim 6, wherein said electrostatic quadrupole lens for the outer electron beams produces a weaker diverging action in the horizontal direction than said electrostatic quadrupole lens for the center electron beam.

10. A color cathode-ray tube comprising at least a panel portion having a phosphor screen on an inner surface thereof, a neck portion, a funnel portion connecting said panel portion and said neck portion, an in-line type electron gun housed in said neck portion, and a deflection yoke for scanning electron beams on the phosphor screen; wherein said electron gun has a cathode, a control electrode, an accelerating electrode and a main lens section disposed in the recited order in a direction toward said phosphor screen:

said main lens section comprising an anode to which an anode voltage is applied, and a focus electrode;

said focus electrode having a first type of focus electrode group to which a first focus voltage is applied, and a second type of focus electrode group to which a second focus voltage is applied;

said second focus voltage is obtained by superposing a voltage, that changes depending upon the deflecting amount of the electron beams, on a predetermined voltage;

between the first type of focus electrode group and the second type of focus electrode group are formed at least two electron lenses including a lens at least having a lens action for correcting the field curvature for focusing the electron beams in both the horizontal direction and the vertical direction, and an electrostatic quadrupole lens for focusing said electron beams in either the horizontal direction or the vertical direction and for diverging the electron beams in the other of said directions;

three electron beam passage holes are formed in the electrodes that form said lens at least having a lens action for correcting the field curvature, and the horizontal diameter of the outer electron beam passage holes in the first type of focus electrode is larger than the horizontal diameter of the outer electron beam passage holes in the second type of focus electrode; and said electrostatic quadrupole lens exhibits different intensities for the outer electron beams relative to the center electron beam.

11. A color cathode-ray tube according to claim 10, wherein said anode forming a portion of said main lens section in said electron gun and an electrode belonging to said second type of focus electrode group neighboring said anode, have electron beam passage holes through which the three electron beams arranged in said horizontal direction pass, and the centers of the outer electron beam passage holes in said anode are deviated on a horizontal plane relative to the centers of said outer electron beam passage holes in said second type of focus electrode group.

12. A color cathode-ray tube according to claim 10, wherein said accelerating electrode neighbors said first type of focus electrode, said accelerating electrode and said first type of focus electrode, respectively, have electron beam passage holes through which the three electron beams arranged in the horizontal direction pass, and the centers of the outer electron beam passage holes in said first type of focus electrode are deviated on a horizontal plane relative to the centers of the outer electron beam passage holes in said accelerating electrode.

13. A color cathode-ray tube according to claim 10, wherein said electrostatic quadrupole lens for the outer electron beams produces a stronger diverging action in the horizontal direction than said electrostatic quadrupole lens for the center electron beam.

14. A color cathode-ray tube according to claim 10, wherein among the three electron beam passage holes formed in the first type of focus electrode and in the second type of focus electrode forming the lens at least having a lens action for correcting the field curvature, the outer electron beam passage holes formed in the first type of focus electrode have a vertical diameter which is equal to a vertical diameter of the outer electron beam passage holes formed in the second type of focus electrode, and said electrostatic quadrupole lens exhibits a stronger action for the outer electron beams than for the center electron beam.

15. A color cathode-ray tube comprising at least a panel portion having a phosphor screen on an inner surface thereof, a neck portion, a funnel portion connecting said panel portion and said neck portion, an in-line type electron gun housed in said neck portion, and a deflection yoke for scanning electron beams on the phosphor screen; wherein said electron gun has a cathode, a control electrode, an accelerating electrode and a main lens section disposed in the recited order in a direction toward said phosphor screen:

said main lens section comprising an anode to which an anode voltage is applied, and a focus electrode;

said focus electrode having first type of focus electrode group to which a first focus voltage is applied, and a second type of focus electrode group to which a second focus voltage is applied;

said second focus voltage is obtained by superposing a voltage, that changes depending upon the deflecting amount of the electron beams, on a predetermined voltage;

between the first type of focus electrode group and the second type of focus electrode group are formed at least two electron lenses including a lens at least having a lens action for correcting the field curvature for focusing the electron beams in both the horizontal direction and the vertical direction, and an electrostatic quadrupole lens for focusing said electron beams in either the horizontal direction or the vertical direction and for diverging the electron beams in the other of said directions;

three electron beam passage holes are formed in the electrodes that form said lens at least having a lens action for correcting the field curvature, and the horizontal diameter of the outer electron beam passage holes in the first type of focus electrode is smaller than the horizontal diameter of the outer electron beam passage holes in the second type of focus electrode; and said electrostatic quadrupole lens exhibits different intensities for the outer electron beams relative to the center electron beam.

16. A color cathode-ray tube according to claim 15, wherein said anode forming a portion of said main lens section in said electron gun and the second type of focus electrode neighboring said anode, have electron beam passage holes through which the three electron beams arranged in said horizontal direction pass, and the centers of the outer electron beam passage holes in said anode are deviated on a horizontal plane relative to the centers of said outer electron beam passage holes in said second type of focus electrode group.

17. A color cathode-ray tube according to claim 15, wherein said accelerating electrode neighbors said first type of focus electrode, said accelerating electrode and said first type of focus electrode, respectively, have electron beam passage holes through which the three electron beams arranged in the horizontal direction pass, and the centers of the outer electron beam passage holes in said first type of focus electrode are deviated on a horizontal plane relative to the centers of the outer electron beam passage holes in said accelerating electrode.

18. A color cathode-ray tube according to claim 15, wherein said electrostatic quadrupole lens for the outer electron beams produces a weaker diverging action in the horizontal direction than said electrostatic quadrupole lens for the center electron beam.

19. A color cathode-ray tube according to claim 15, wherein among the three electron beam passage holes formed in the first type of focus electrode and in the second type of focus electrode forming the lens at least having a lens action for correcting the field curvature, the outer electron beam passage holes formed in the first type of focus electrode have a vertical diameter which is equal to a vertical diameter of the outer electron beam passage holes formed in the second type of focus electrode, and said electrostatic quadrupole lens exhibits a weaker action for the outer electron beams than for the center electron beam.

* * * * *